US010987793B2

(12) United States Patent
Bixler et al.

(10) Patent No.: US 10,987,793 B2
(45) Date of Patent: Apr. 27, 2021

(54) POWER TOOL WITH TOOL HOUSING AND OUTPUT SPINDLE HOUSING

(71) Applicant: Black & Decker Inc., New Britain, CT (US)

(72) Inventors: Clark A. Bixler, York, PA (US); Beverly T. Mathews, White Hall, MD (US); Jeffrey P. Grant, Forest Hill, MD (US)

(73) Assignee: Black & Decker Inc., New Britain, CT (US)

( * ) Notice: Subject to any disclaimer, the term of this patent is extended or adjusted under 35 U.S.C. 154(b) by 525 days.

(21) Appl. No.: 15/407,018

(22) Filed: Jan. 16, 2017

(65) Prior Publication Data

US 2017/0120437 A1 May 4, 2017

Related U.S. Application Data

(60) Continuation of application No. 13/468,351, filed on May 10, 2012, now Pat. No. 9,579,785, which is a (Continued)

(51) Int. Cl.
*B25F 5/00* (2006.01)
*B25F 5/02* (2006.01)

(52) U.S. Cl.
CPC ..... *B25F 5/02* (2013.01); *B25F 5/001* (2013.01); *Y10T 29/49895* (2015.01)

(58) Field of Classification Search
CPC .... B25F 5/02; B25F 5/001; B25F 5/00; B25F 3/00; B23B 45/001; B25B 21/026; B25D 16/00

(Continued)

(56) References Cited

U.S. PATENT DOCUMENTS 1,228,472 A 8/1917 Olson
1,404,984 A 1/1922 Lower (Continued)

FOREIGN PATENT DOCUMENTS

DE 1903434 A1 10/1964
DE 1478982 A1 1/1970

(Continued)

OTHER PUBLICATIONS

Festo Catalogue 96/97; pp. 1-4 and 10-19.

(Continued)

*Primary Examiner* — Andrew M Tecco
*Assistant Examiner* — Eyamindae C Jallow
(74) *Attorney, Agent, or Firm* — Scott B. Markow

(57) ABSTRACT

A power tool includes a tool housing defining an interior cavity and a trigger mount. The trigger mount is adapted to receive a trigger therein. A spindle housing contains an output spindle assembly having an output spindle rotatably mounted in the spindle housing. One of the tool housing and the spindle housing includes a plurality of longitudinally-extending, spaced-apart tongues and the other of the tool housing and the spindle housing includes a plurality of longitudinally-extending, spaced-apart grooves. The spindle housing may be coupled to the tool housing such that each of the grooves receive an associated one of the tongues.

19 Claims, 22 Drawing Sheets

Related U.S. Application Data division of application No. 13/114,613, filed on May 24, 2011, now Pat. No. 8,205,685, which is a division of application No. 11/453,315, filed on Jun. 14, 2006, now Pat. No. 7,980,324.

(60) Provisional application No. 60/765,490, filed on Feb. 3, 2006.

(58) Field of Classification Search
USPC ..... 173/29
See application file for complete search history.

(56) References Cited

U.S. PATENT DOCUMENTS 1,514,872 A 11/1924 Starr
1,693,139 A 11/1928 Dietsche
1,792,484 A 2/1931 Fawick
1,909,330 A 5/1933 Banker
2,137,778 A 11/1938 McCullough
2,291,464 A 7/1942 Banker
2,331,684 A 10/1943 Henningsen
2,468,646 A 4/1949 Verhoff
2,787,919 A 4/1957 Senkowski et al.
2,836,272 A 5/1958 Kaman
2,848,908 A 8/1958 Hollis
2,878,919 A 3/1959 Jones
2,911,854 A 11/1959 Fabian
2,923,191 A 2/1960 Fulop
3,055,236 A 9/1962 Born, Jr.
3,127,801 A 4/1964 Binns
3,250,539 A 5/1966 Kurz et al.
3,349,651 A 10/1967 Turnbull et al.
3,364,963 A 1/1968 Turnbull
3,476,960 A 11/1969 Rees
3,550,243 A 12/1970 Allsop
3,610,343 A 10/1971 Bratt
3,685,594 A 8/1972 Koehler
3,718,054 A 2/1973 Perkins et al.
3,736,992 A 6/1973 Zander et al.
3,739,659 A 6/1973 Workman, Jr.
3,757,605 A 9/1973 Morden
3,774,476 A 11/1973 Sohnlein et al.
3,783,955 A 1/1974 Gill
3,808,904 A 5/1974 Gotsch et al.
3,828,863 A 8/1974 Bleicher et al.
3,837,409 A 9/1974 Consoli et al.
3,845,826 A 11/1974 Beisch
3,847,229 A 11/1974 Wanner et al.
3,867,988 A 2/1975 Koehler
3,872,742 A 3/1975 States
3,878,926 A 4/1975 Adachi
3,901,104 A 8/1975 Sims
3,906,534 A 9/1975 Shirasaki
3,934,629 A 1/1976 Boman
4,017,878 A 4/1977 Hagiwara
4,070,927 A 1/1978 Polak
4,178,813 A 12/1979 Smemo
4,215,594 A 8/1980 Workman, Jr. et al.
4,274,023 A 6/1981 Lamprey
4,274,304 A 6/1981 Curtiss
4,323,354 A 4/1982 Blanchard
4,366,871 A 1/1983 Dieterie et al.
4,416,168 A 11/1983 Arai et al.
4,418,766 A 12/1983 Grossman
4,448,098 A 5/1984 Totsu
4,453,430 A 6/1984 Sell
4,490,910 A 1/1985 Mattson et al.
4,493,223 A 1/1985 Kishi et al.
4,513,827 A 4/1985 Dubiel
4,536,688 A 8/1985 Roger
4,569,252 A 2/1986 Harper
4,585,077 A 4/1986 Bergler
4,617,837 A 10/1986 Kataoka et al.
4,620,824 A 11/1986 Eckstein et al.
4,621,541 A 11/1986 Takahashi
4,628,159 A 12/1986 Deitch et al.
4,641,551 A 2/1987 Pascaloff
4,650,007 A 3/1987 Fujita et al.
4,651,580 A 3/1987 Deane
4,655,103 A 4/1987 Schreiber et al.
4,710,071 A 12/1987 Koehler et al.
4,756,216 A 7/1988 Lo
4,757,598 A 7/1988 Redman
4,759,729 A 7/1988 Kemppainen et al.
4,772,765 A 9/1988 Markle et al.
4,791,833 A 12/1988 Sakai et al.
4,810,916 A 3/1989 McBride
4,834,192 A 5/1989 Mansson
4,842,078 A 6/1989 Hansson
4,869,131 A 9/1989 Ohmori
4,869,139 A 9/1989 Gotman
4,875,528 A 10/1989 Thackston
4,892,013 A 1/1990 Satoh
4,898,249 A 2/1990 Ohmori
4,908,926 A 3/1990 Takeshima et al.
4,966,057 A 10/1990 Koppatsch
4,967,888 A 11/1990 Lippacher et al.
4,986,369 A 1/1991 Fushiya et al.
5,004,054 A 4/1991 Sheen
5,005,682 A 4/1991 Young et al.
5,019,023 A 5/1991 Kurosawa
5,025,903 A 6/1991 Elligson
5,038,084 A 8/1991 Wing
5,050,291 A 9/1991 Gilmore
5,054,588 A 10/1991 Thorp et al.
5,094,133 A 3/1992 Schreiber
5,159,986 A 11/1992 Moser
5,176,593 A 1/1993 Yasui et al.
5,232,018 A 8/1993 Rush et al.
5,277,527 A 1/1994 Yokota et al.
5,282,510 A 2/1994 Pacher
5,301,565 A 4/1994 Weismann et al.
5,339,908 A 8/1994 Yokota et al.
5,343,961 A 9/1994 Ichikawa
5,372,206 A 12/1994 Sasaki et al.
5,451,127 A 9/1995 Chung
5,456,324 A 10/1995 Takagi et al.
5,535,867 A 7/1996 Cocccaro et al.
5,550,416 A 8/1996 Fanchang et al.
5,551,927 A 9/1996 Enzmann et al.
5,566,458 A 10/1996 Bednar
5,573,074 A 11/1996 Thames et al.
5,598,911 A 2/1997 Joachim et al.
5,601,491 A 2/1997 Chan et al.
5,692,575 A 12/1997 Hellstrom
5,704,433 A 1/1998 Bourner et al.
5,730,232 A 3/1998 Mixer
5,842,527 A 12/1998 Arakawa et al.
5,897,454 A 4/1999 Cannaliato
5,903,462 A 5/1999 Wagner et al.
5,937,985 A 8/1999 Dover et al.
5,954,608 A 9/1999 Kirkwood et al.
5,967,934 A 10/1999 Ishida et al.
6,039,126 A 3/2000 Hsieh
6,062,114 A 5/2000 Rahm
6,070,675 A 6/2000 Mayer et al.
6,076,438 A 6/2000 Rahm
6,086,502 A 7/2000 Chung
6,093,128 A 7/2000 Seith
6,142,242 A * 11/2000 Okumura ..... B25B 23/141 173/216
6,142,243 A 11/2000 Mayer
6,170,579 B1 * 1/2001 Wadge ..... B25F 3/00 173/170
6,193,629 B1 2/2001 Tenzor et al.
6,196,943 B1 3/2001 Chen
6,230,819 B1 * 5/2001 Chen ..... B25F 5/001 173/48
6,305,481 B1 10/2001 Yamazaki et al.
6,431,289 B1 * 8/2002 Potter ..... B23B 45/008 173/216
6,457,535 B1 10/2002 Tanaka
6,502,648 B2 1/2003 Milbourne

(56) References Cited

U.S. PATENT DOCUMENTS

| | | | | |
|---|---|---|---|---|
| 6,523,658 | B2 | 2/2003 | Furuta et al. | |
| 6,533,093 | B2 | 3/2003 | Chen | |
| 6,676,557 | B2 | 1/2004 | Milbourne et al. | |
| 6,691,796 | B1 * | 2/2004 | Wu | B25D 16/006 173/109 |
| 6,805,207 | B2 | 10/2004 | Hagan et al. | |
| 6,857,983 | B2 | 2/2005 | Milbourne et al. | |
| 6,892,827 | B2 | 5/2005 | Toyama et al. | |
| 6,902,013 | B2 | 6/2005 | Aeberhard | |
| 6,984,188 | B2 | 1/2006 | Potter et al. | |
| 7,021,399 | B2 * | 4/2006 | Driessen | B25F 3/00 173/216 |
| 7,101,300 | B2 | 9/2006 | Milbourne et al. | |
| 7,201,235 | B2 | 4/2007 | Umemura et al. | |
| 7,410,007 | B2 | 8/2008 | Chung et al. | |
| 7,588,094 | B2 * | 9/2009 | Lin | B25B 21/00 173/178 |
| 7,980,324 | B2 | 7/2011 | Bixler et al. | |
| 8,851,812 | B1 | 10/2014 | DeRosa | |
| 9,956,677 | B2 * | 5/2018 | Baskar | B25F 3/00 |
| 2001/0048855 | A1 * | 12/2001 | Lin | B25B 21/00 408/16 |
| 2002/0096341 | A1 * | 7/2002 | Hagan | B25B 21/00 173/170 |
| 2002/0096342 | A1 * | 7/2002 | Milbourne | B25B 21/00 173/178 |
| 2002/0096343 | A1 * | 7/2002 | Potter | B23B 45/02 173/216 |
| 2002/0098938 | A1 | 7/2002 | Milbourne et al. | |
| 2002/0179310 | A1 * | 12/2002 | Kuhnle | B23Q 3/12 173/114 |
| 2003/0002934 | A1 * | 1/2003 | Hsu | B25F 5/02 408/16 |
| 2004/0211576 | A1 | 10/2004 | Milbourne et al. | |
| 2005/0135084 | A1 * | 6/2005 | Chen | B25B 21/00 362/109 |
| 2005/0257945 | A1 * | 11/2005 | Justis | B25F 5/02 173/217 |
| 2006/0096771 | A1 * | 5/2006 | Brotto | B25B 21/00 173/217 |
| 2006/0144185 | A1 * | 7/2006 | Tsai | B25F 5/001 74/527 |
| 2007/0119607 | A1 | 5/2007 | Lin | |
| 2010/0171326 | A1 | 7/2010 | Bacon | |
| 2011/0283480 | A1 | 11/2011 | Chang | |
| 2013/0161040 | A1 | 6/2013 | Tomayko et al. | |

FOREIGN PATENT DOCUMENTS

| | | | |
|---|---|---|---|
| DE | 2920065 | A1 | 11/1980 |
| DE | 3904085 | A1 | 8/1990 |
| DE | 9016415 | U1 | 9/1991 |
| DE | 4038226 | A1 | 6/1992 |
| DE | 4038502 | A1 | 6/1992 |
| DE | 4213291 | A1 | 10/1993 |
| DE | 4406018 | C1 | 4/1995 |
| DE | 19903863 | A1 | 8/2000 |
| DE | 20008377 | U1 | 8/2000 |
| EP | 0212381 | A1 | 3/1987 |
| EP | 0411483 | A1 | 7/1990 |
| EP | 0404035 | A2 | 12/1990 |
| EP | 0519121 | A2 | 4/1997 |
| EP | 0787931 | A1 | 8/1997 |
| EP | 1413778 | A1 | 4/2004 |
| FR | 1072143 | | 9/1954 |
| FR | 1386141 | | 1/1965 |
| GB | 2063394 | A | 6/1981 |
| GB | 2102515 | A | 2/1983 |
| GB | 2334910 | A | 9/1999 |
| JP | 4956276 | | 5/1974 |
| JP | 57139330 | | 8/1982 |
| JP | 584308 | | 1/1983 |
| JP | 59140179 | | 9/1984 |
| JP | 6034275 | | 2/1985 |
| JP | 62224584 | | 10/1987 |
| JP | 6396453 | | 6/1988 |
| JP | 3004054 | | 1/1991 |
| JP | 6320435 | | 11/1994 |
| JP | H0740258 | | 2/1995 |
| JP | H07148669 | | 6/1995 |
| JP | 2143073 | | 10/1997 |
| JP | 1058217 | | 3/1998 |
| WO | WO-92-09406 | | 6/1992 |
| WO | WO-97-33721 | | 9/1997 |
| WO | WO-99-16585 | | 4/1999 |
| WO | WO-00-23727 | | 4/2000 |
| WO | WO-01-78948 | | 10/2001 |
| WO | WO-02-58883 | | 8/2002 |
| WO | WO-04-20156 | | 3/2004 |

OTHER PUBLICATIONS

Festool Festo Tooltechnic CDD 9, 6ES Exploded View (457 895/10.99).
Tools of the Trade Online: Stop the Pain (Spring 1998).
DeWalt DW964K Type 1: Parts Listing and exploded view of 9.6v VersaClutch Drill/Driver.
DeWalt DW974K Type 1: Parts Listing and exploded view of 12v VersaClutch Drill/Driver.

* cited by examiner

POWER TOOL WITH TOOL HOUSING AND OUTPUT SPINDLE HOUSING

CROSS REFERENCE TO RELATED APPLICATIONS

This application is a continuation of U.S. application Ser. No. 13/468,351, filed May 10, 2012, which is a division of U.S. application Ser. No. 13/114,613, filed May 24, 2011 (now U.S. Pat. No. 8,205,685), which is a division of U.S. application Ser. No. 11/453,315 (now U.S. Pat. No. 7,980, 324 issued Jul. 19, 2011), which claims the benefit of U.S. Provisional Application No. 60/765,490 filed Feb. 3, 2006. The entire disclosure of each of the above applications is incorporated herein by reference.

This patent application may be related to the following references: U.S. Pat. Nos. 6,676,557; 6,857,983; 7,220,211; 7,537,064; 6,984,188; 7,101,300; 6,502,648; and 7,314,097 and International Patent Application (PCT) Publication Nos. WO 02/059491, WO 20/05093290; and WO 02/058883. The above references are hereby incorporated by reference in their entirety as if fully set forth herein.

TECHNICAL FIELD

The present disclosure generally relates to a power tool.

BACKGROUND

This section provides background information related to the present disclosure which is not necessarily prior art.

Manufacturers have introduced rotary power tools that have variable speed motors and multi-stage multi-speed transmissions. The tools may provide the user with sufficient control over the output speed and the torque of the tool so as to facilitate diverse operations without resorting to additional specialized tools. While the tools have performed satisfactorily, there remains room in the art for improvements to increase performance and reduce complexity and cost.

One manner for improvements to performance and the lowering of costs concerns the manner in which a transmission assembly can be mounted to the housing of a power tool. For example, U.S. Pat. No. 6,431,289 describes an arrangement in which the transmission assembly Includes a transmission sleeve into which a reduction gearset assembly is received. The transmission sleeve includes first grooves that are configured to receive alignment ribs formed on mating handle shells to mount the transmission assembly to the handle shell in a manner that permits the transmission assembly to slide axially relative to the handle shell. Such configuration can be advantageous in some circumstances (e.g., the configuration permits the transmission assembly to be withdrawn from a handle shell assembly without separating the two handle shells from one another). We have determined, however, that improvements to the power tool are needed to facilitate more cost efficient volume production.

SUMMARY

This section provides a general summary of the disclosure, and is not a comprehensive disclosure of its full scope or all of its features.

The present teachings generally include a power tool having a motor, an output member and a transmission disposed between the motor and the output member. The transmission includes a ring gear with opposite axial end faces. The power tool also includes a clutch for limiting an output of the transmission. The clutch includes an annular clutch face disposed about the ring gear. At least a portion of a side of the ring gear is configured such that an included angle between the annular clutch face and the at least a portion of the side of the ring gear is about ninety five degrees to about one hundred fifty degrees.

In still another form, the teachings of the present disclosure provide a power tool with a handle housing, a motor, an output member and a cassette. The handle housing that defines a handle. The motor is received in the handle housing. The cassette is received in the handle housing and includes a transmission housing, a multi-stage transmission received in the transmission housing, and a rear thrust washer. The transmission housing has a first end with first and second circumferentially extending channels formed therein. The rear thrust washer has a body and first and second lock members that extend radially from the body. Each of the first and second lock members is received in an associated one of the first and second circumferentially extending channels.

In yet another form, the present teachings provide a power tool with a handle housing, a motor, an output member and a cassette. The handle housing that defines a handle. The motor is received in the handle housing. The cassette is received in the handle housing and includes a transmission housing, a multi-stage transmission received in the transmission housing, and a front cap. The transmission housing has a front end with at least one circumferentially extending rib member that extends at least partially about the front end of the transmission housing. The front cap has an annular flange with a groove for receiving the at least one circumferentially extending rib member.

In a further form the present teachings provide a power tool with a handle housing, a motor, an output spindle, a transmission and a spindle lock clutch. The handle housing defines a handle. The motor received in the handle housing. The transmission is received in the handle housing and transmits power between the motor and the output spindle. The transmission having an output member. The spindle lock clutch has an anvil and a circular seal member. The anvil has a first portion and a second portion that extends from the first portion. The anvil defines an aperture into which the anvil receives an end of the output spindle. The second portion having a polygonal shape. The output member defines an aperture with a shape complementary to the polygonal shape of the second portion of the anvil. The aperture in the output member receives the second portion of the anvil. The anvil includes a groove formed in a face of the first portion from which the second portion extends. The groove encircling the second portion. The circular seal member being received in the groove and disposed between the anvil and the output member.

In another form, the present teachings provide a power tool that includes a housing, a motor, a trigger, an output spindle and a transmission assembly. The housing has a pair of mating housing shells that cooperate to define a handle and a pair of first mounts. The motor is received in the housing shells and has an output shaft. The trigger is coupled to the housing shells and is configured to control operation of the motor. The transmission assembly has a transmission sleeve, a multi-speed reduction gearset, a first thrust washer and a second thrust washer. The transmission sleeve has a pair of second mounts that cooperate with the first mounts to permit the transmission sleeve to be received into either one of the housing shells in a single desired axial location and a single desired radial orientation. The multi-speed reduction gearset is received in the transmission sleeve and transmits rotary power between the motor and the output spindle. The multi-speed reduction gearset has an input pinion that is mounted on the output shaft of the motor. The first thrust washer is fixedly coupled to the transmission sleeve and includes a first body with a first aperture through which the motor output shaft and the input pinion are received. The second thrust washer is fixedly coupled to the transmission sleeve on an end opposite the first thrust washer. The second thrust washer has a second body with a second aperture through which the output spindle is received. The first thrust washer is not press-fit to the transmission sleeve.

In still another form, the present teachings provide a power tool that includes a housing, a motor, a trigger, an output spindle and a transmission assembly. The housing has a pair of mating housing shells that cooperate to define a handle and a pair of first mounts. Each of the first mounts includes a pair of circumferentially spaced-apart ribs. At least one of the circumferentially-spaced apart ribs is contoured to define a notch. The motor is received in the housing shells and has an output shaft. The trigger is coupled to the housing shells and configured to control operation of the motor. The transmission assembly has a transmission sleeve, a multi-speed reduction gearset, a first thrust washer and a second thrust washer. The transmission sleeve has a pair of second mounts. Each of the second mounts includes a boss that is configured to be received in an associated one of the notches between a corresponding pair of the circumferentially-spaced apart ribs to thereby inhibit axial and rotational movement of the transmission sleeve relative to the housing. The multi-speed reduction gearset is received in the transmission sleeve and transmits rotary power between the motor and the output spindle. The multi-speed reduction gearset has an input pinion that is mounted on the output shaft of the motor. The first thrust washer is fixedly coupled to the transmission sleeve and includes a first body with a first aperture through which the motor output shaft and the input pinion are received. The second thrust washer is fixedly coupled to the transmission sleeve on an end opposite the first thrust washer. The second thrust washer has a second body with a second aperture through which the output spindle is received. The first thrust washer is not press-fit to the transmission sleeve.

In still another form, the present teachings provide a method for forming a power tool. The method includes; providing a first housing shell, the first housing shell having a first mount comprising a first pair of circumferentially spaced-apart ribs, wherein one of the ribs of the first pair of circumferentially-spaced apart ribs is contoured to define a notch; providing a transmission assembly having a transmission sleeve, a multi-speed reduction gearset, a first thrust washer and a second thrust washer, the transmission sleeve having a pair of second mounts, each of the second mounts comprising a boss, the multi-speed reduction gearset being received in the transmission sleeve, the first thrust washer being fixedly coupled to the transmission sleeve and comprising a first body with a first aperture, the second thrust washer being fixedly coupled to the transmission sleeve on an end opposite the first thrust washer, the second thrust washer having a second body with a second aperture; and mounting the transmission assembly to the first housing shell such that one of the bosses on the transmission sleeved is received in the notch to axially and radially align the transmission assembly to the first housing shell.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
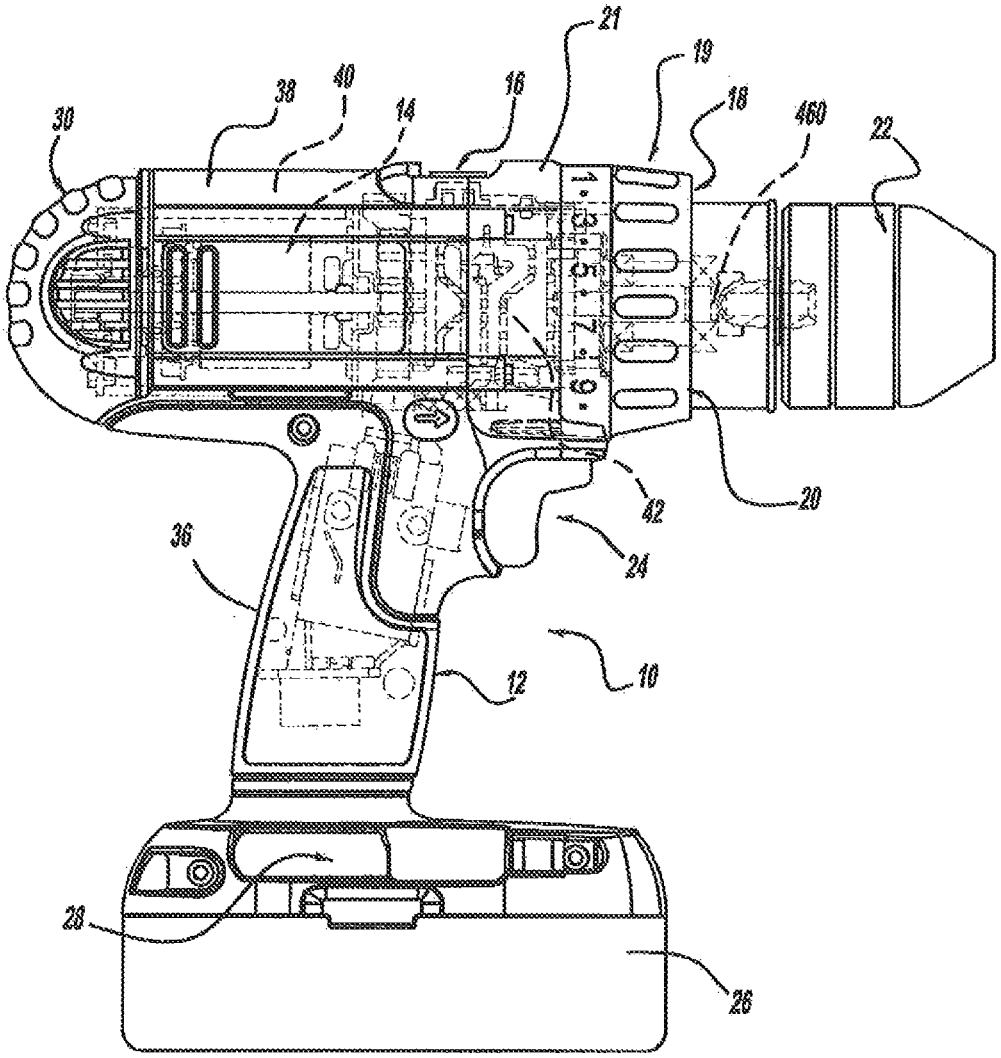
FIG. 1 is a side view of a power tool constructed in accordance with the present teachings.

The following description merely exemplary in nature and is not intended to limit the present teachings, its application, or uses. It should be understood that throughout the drawings corresponding reference numerals indicate like or corresponding parts and features.

Figure 2:
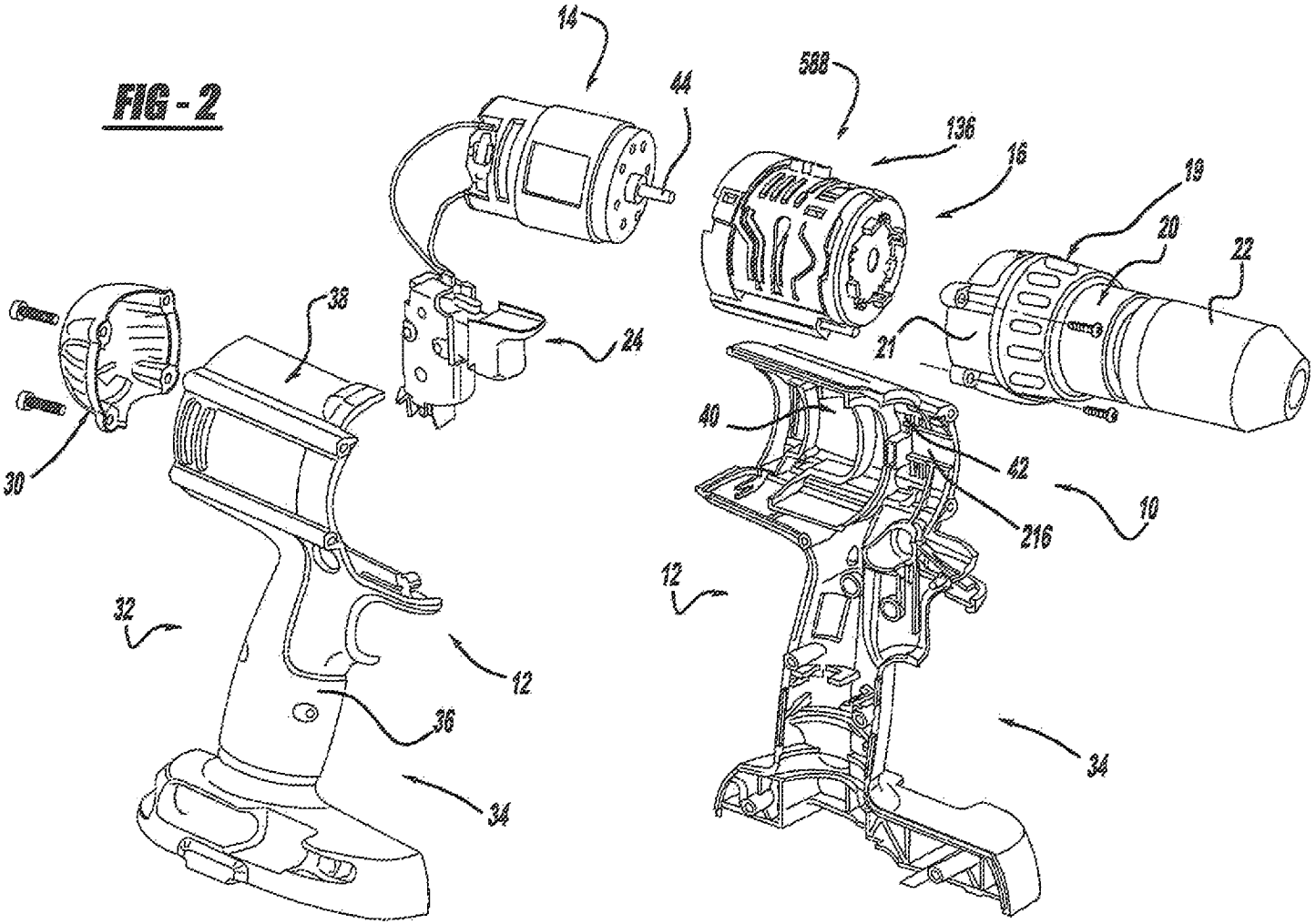
FIG. 2 is an exploded perspective view of a portion of the power tool of FIG. 1.

With reference to FIGS. 1 and 2, a power tool constructed in accordance with the present teachings is generally indicated by reference numeral 10. Various aspects of the present teachings may include either a cord or a cordless (battery operated) device, such as a portable screwdriver or a drill (e.g., drill, hammer drill and/or driver). In FIG. 1, the power tool 10 is illustrated as a cordless drill having a housing 12, a motor assembly 14, a multi-speed transmission assembly 16, a clutch mechanism 18, an output spindle assembly 20 (including a hammer mechanism 19, FIG. 3) contained within a spindle housing 21, a chuck 22, a trigger assembly 24, a battery pack 26 and a holder 28. It will be appreciated that a detailed discussion of several of the components of the power tool 10, such as the hammer mechanism 19, the chuck 22, the trigger assembly 24 and the battery pack 26, are outside the scope of the present disclosure. Reference, however, may be made to a variety of publications for a more complete understanding of the operation and/or features that may be included in combination or individually with the power tool 10. To that end, such publications include one or more of the references set forth above and already incorporated by reference.

Figure 3:
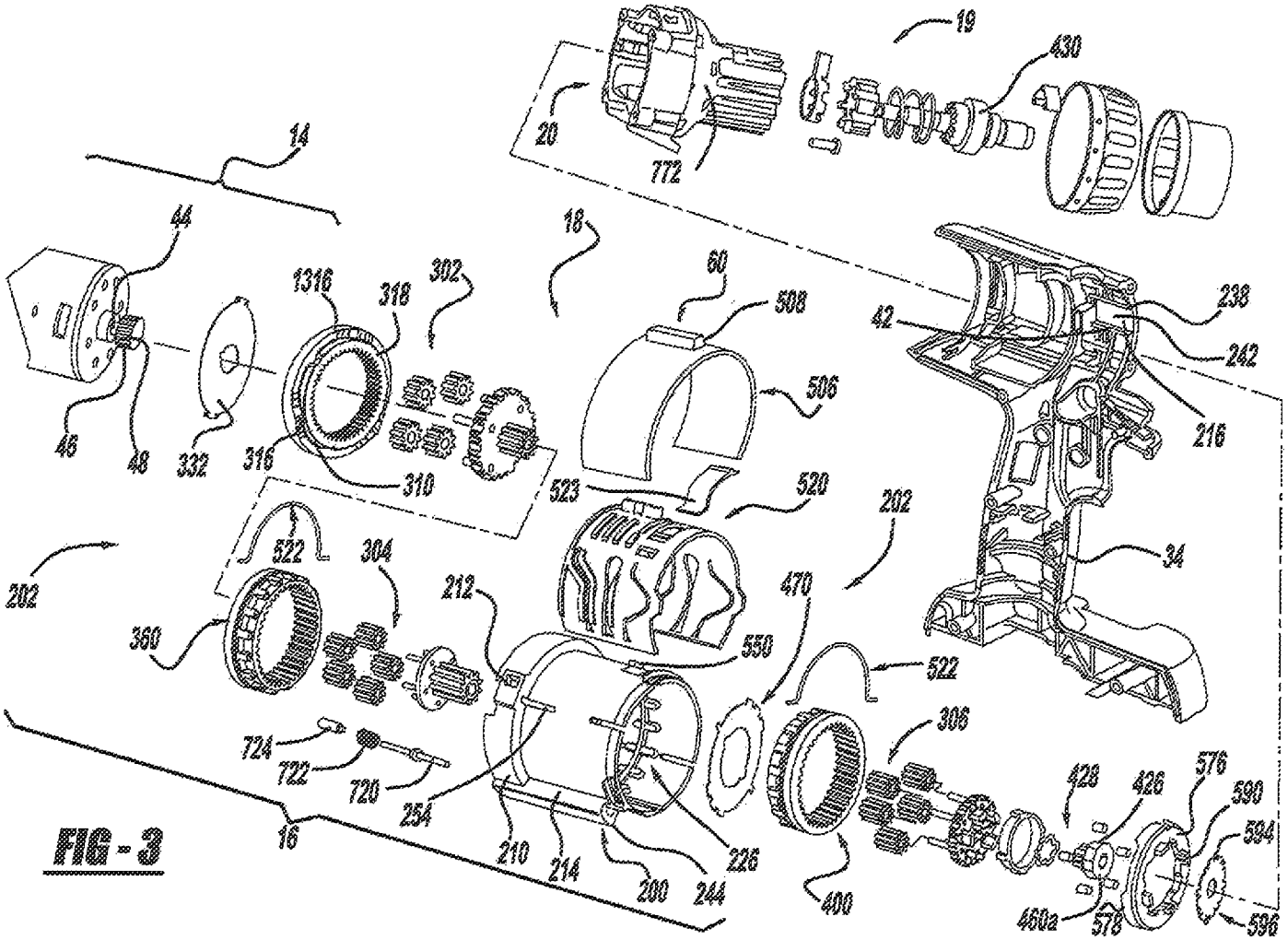
FIG. 3 is an exploded perspective view of a portion of the power tool of FIG. 1 showing a transmission assembly and a hammer drill, assembly in accordance with the present teachings.

With reference to FIG. 2, the housing 12 may include an end cap assembly 30 and a handle shell assembly 32 that may include a pair of mating handle shells 34. In one aspect, one mating handle shell may be referred to as the assembly side, while the other side may be referred to as the cover side. The handle shell assembly 32 may include a handle portion 36 and a drive train or a body portion 38. The trigger assembly 24 and the battery pack 26 may be mechanically coupled to the handle portion 36 and may be electrically coupled to the motor assembly 14. The body portion 38 may include a motor cavity 40 and a transmission cavity 42, The motor assembly 14 may be housed in the motor cavity 40 and may include a rotatable output shaft 44, which may extend into the transmission cavity 42. A motor pinion 46 having a plurality of gear teeth 48 may be coupled for rotation with the output shaft 44, as illustrated in FIG. 3. The trigger assembly 24 and the battery pack 26 may cooperate to selectively provide electrical power to the motor assembly 14 in a suitable manner to selectively control the speed and/or direction at which output shaft 44 may rotate.

Figure 4:
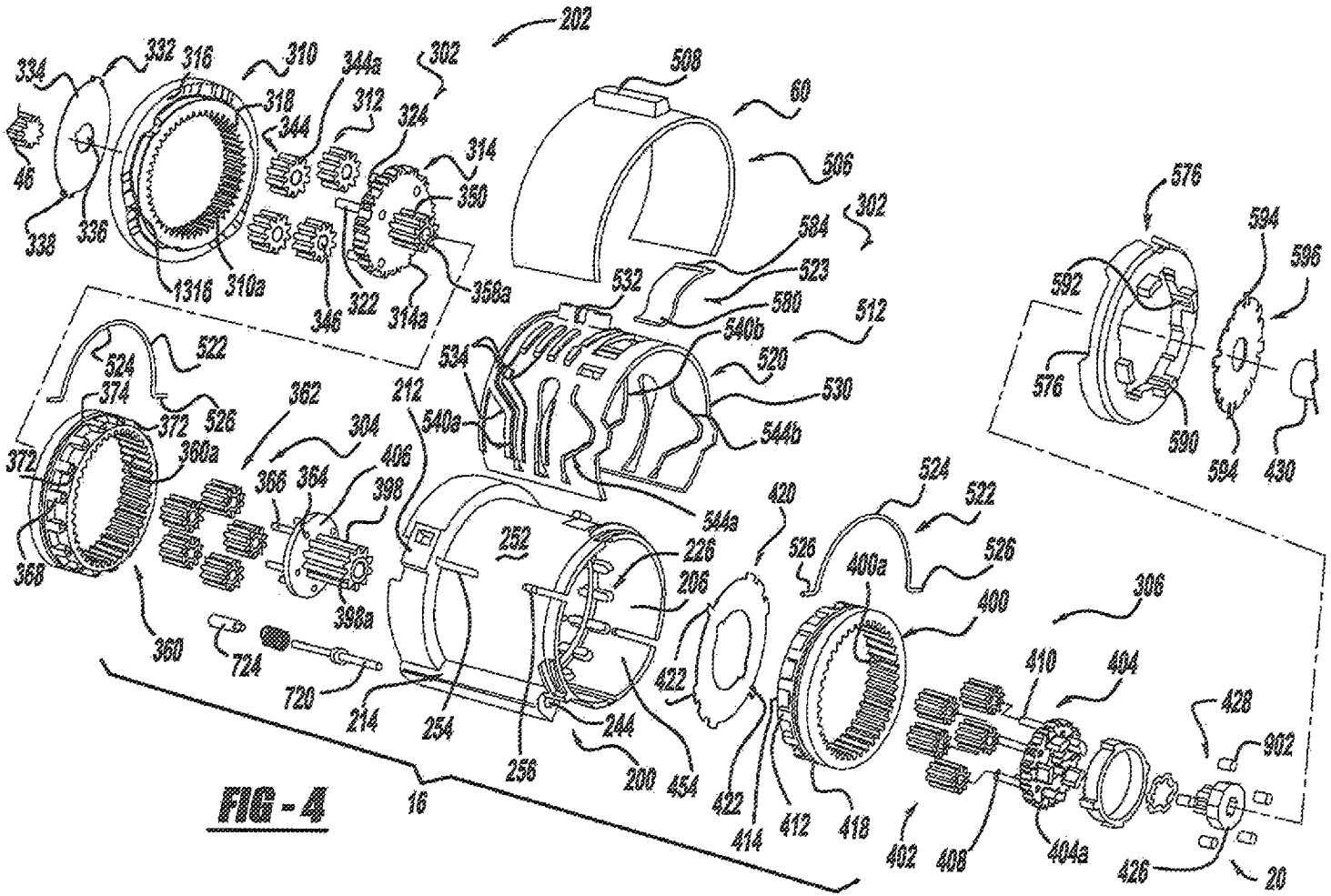
FIG. 4 is similar to FIG. 3 and shows the transmission assembly in further detail.

With reference to FIGS. 3 and 4, the transmission assembly 16 may be housed in the transmission cavity 42 and may include a speed selector mechanism 60. The motor pinion 46 may couple the transmission assembly 16 to the output shaft 44 to transmit a relatively high speed but relatively low torque drive input to the transmission assembly 16. The transmission assembly 16 may include a plurality of reduction elements or reduction gearsets that may be selectively engaged (and disengaged) by the speed selector mechanism 60 to provide a plurality of user-selectable speed ratios. Each of the speed ratios may multiply the speed and the torque of the drive input in a predetermined manner, permitting the output speed and the torque of the transmission assembly 16 to be varied in a desired manner between a relatively low speed but high torque output and a relatively high speed but low torque output. The output from the transmission assembly 16 may be transmitted to the output spindle assembly 20 (FIG. 2). The chuck 22 (FIG. 2) may be incorporated in or coupled for rotation with the output spindle assembly 20 to permit torque to be transmitted to, for example, a tool bit (not shown). The clutch mechanism 18 (also in FIG. 15) may be coupled to the transmission assembly 16 and may be operable for limiting the magnitude of the torque associated with the drive input to a predetermined and selectable torque limit.

The transmission assembly 16 may be a three-stage, three-speed transmission that may include a transmission sleeve 200, a reduction gearset assembly 202 and the speed selector mechanism 60. With additional reference to FIGS. 5 through 7, the transmission sleeve 200 may include a wall member 204 that generally may define a transmission bore or a hollow cavity 206 into which the reduction gearset assembly 202 may be contained. The transmission sleeve 200 may include a body 208 and a base 210. The body 208 of the transmission sleeve 200 may be generally uniform in diameter and may be smaller in diameter than the base 210.

The base 210 may include a pair of bosses 212 formed along an outer periphery of the base 210. Also, a pin housing 214 may be formed in the base 210 and the body 208. As shown in FIG. 2, the mating shells 34 may each include a groove 216 formed on an interior surface of the mating shell 34. Each groove may receive an associated boss 212 that may be formed on the transmission sleeve 200. In this regard, each groove 216 may align and/or may hold the transmission sleeve 200 in the handle mating shells 34 (FIG. 2) and may inhibit relative rotation between the transmission sleeve 200 and the housing 12 (FIG. 2). In one example, the pair of bosses 212, the pair of grooves 216 and the pin housing 214 may be configured in a manner such that the transmission sleeve 200 may only be assembled to the handle shells 34 in one orientation (e.g., the speed selector mechanism 60 upward and the pin housing 214 downward relative to FIG. 3).

Figure 7:
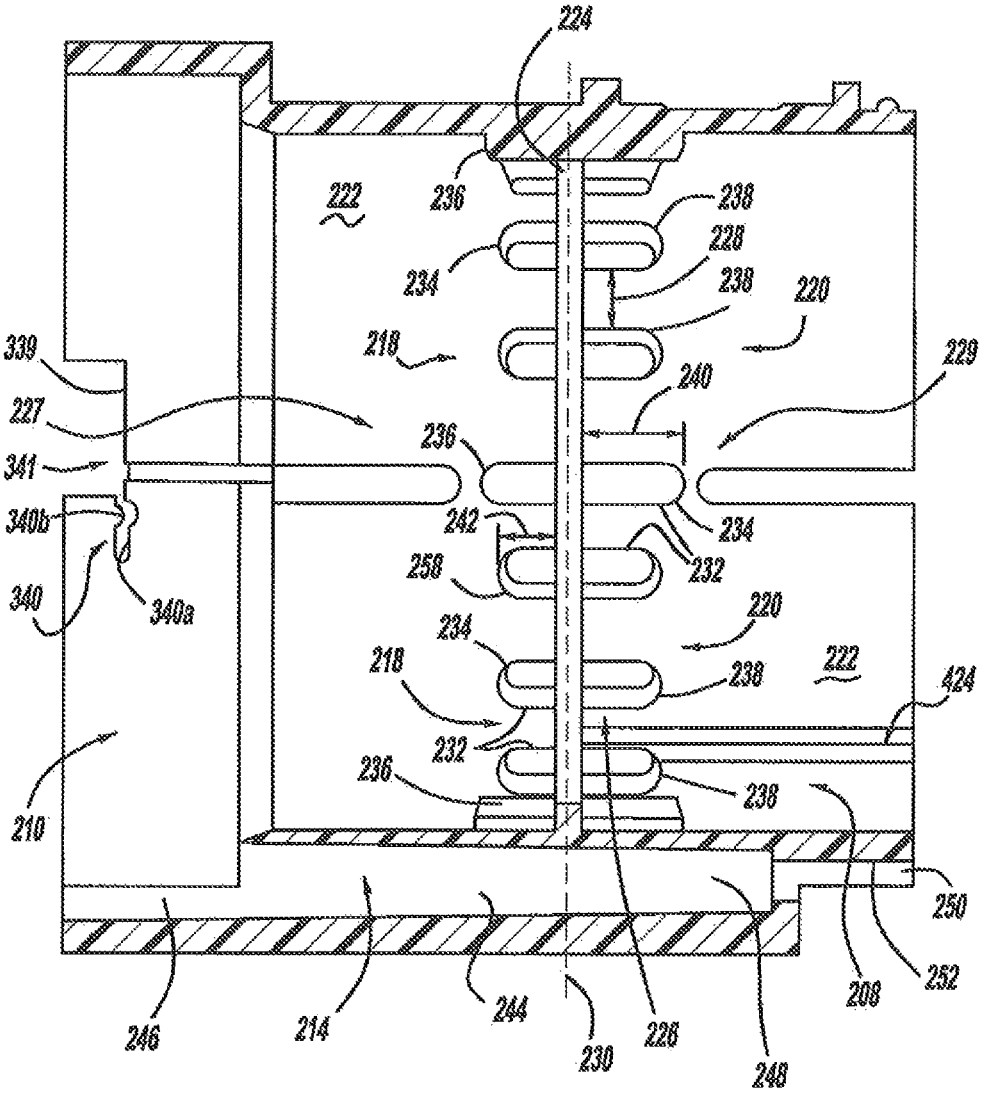
FIG. 7 is a cross-sectional view taken from FIG. 6.

With reference to FIG. 7, the body 208 of the transmission sleeve 200 may include a first and a second set of ring engagement teeth 218 and 220, respectively formed on an inner surface 222 of the body 208. A raised bead 224 may extend from the inner surface 222 (i.e., integral to or coupled together) and may segregate the inner surface 222 of the body 208 into first and second housing portions 227 and 229, respectively. The first set of ring engagement teeth 218 may extend from the inner surface 222 of the body 208 (i.e., may be integral to or may be coupled together) and may extend rearwardly from the raised bead 224 toward the base 210. The second set of ring engagement teeth 220 may also be formed onto the inner surface 222 of the body 208 but may extend forwardly from the raised bead 224 away from the base 210 and may be similar to that of the first set of engagement teeth 218.

In one aspect of the present teachings, teeth 226 of the first and second sets of ring engagement teeth 218, 220 may be uniformly spaced a dimension 228 around the inner surface 222 of the body 208 and may be aligned along a single diametral plane 230. The configuration of each tooth 226 in the first and second sets 218, 220 may be similar in that each tooth 226 may extend from the raised bead 224, may have a pair of generally parallel engagement surfaces 232 and may terminate at a tip portion 234. Moreover, the tip portion 234 of each tooth 226 may be both rounded and tapered to enhance the ability with which it may mesh with a portion of the reduction gearset assembly 202.

In another aspect of the present teachings, a first set. 236 of the teeth 226 in the first and/or second sets of ring engagement teeth 218, 220 (e.g., four of sixteen teeth 226) may be longer than a second set 238 of teeth 226. The second set 238 may be the remaining teeth, i.e., the other teeth 226 besides the teeth 226 from the first set 236. By way of the above example, the four teeth (or some suitable portion of the total amount of teeth 226) may define a dimension 240 from the raised bead 224 to the tip portion 234. Similarly, the teeth 226 of the second set 238 may define a dimension 242 from the raised bead 224 to the tip portion 234. The dimension 240 may be greater (i.e., longer) than the dimension 242 such that the teeth 226 in the first set 236 may be longer (axially) than the teeth 226 in the second set 238.

In one aspect, the teeth 226 in the first set 236 may be longer than the teeth 226 in the second set 238 on either or both sides of the raised bead 224 or diametral plane 230. In another aspect, the teeth 226 of the first set 236 and the second set 238 may also be the same length. Specifically, the tip portions 234 of the teeth 226 in the first set 236 may be offset and thus a greater distance from the raised bead 224 and/or the diametral plane 230 of the teeth 226 of the second set 238. In this regard, the teeth 226 in the first set 236 and/or the second set 238 may not connect or be integral to the raised bead 224 but may be spaced therefrom in contrast to the teeth 226 straddling or integral to the raised bead 224, as illustrated in FIG. 7.

Figure 5:
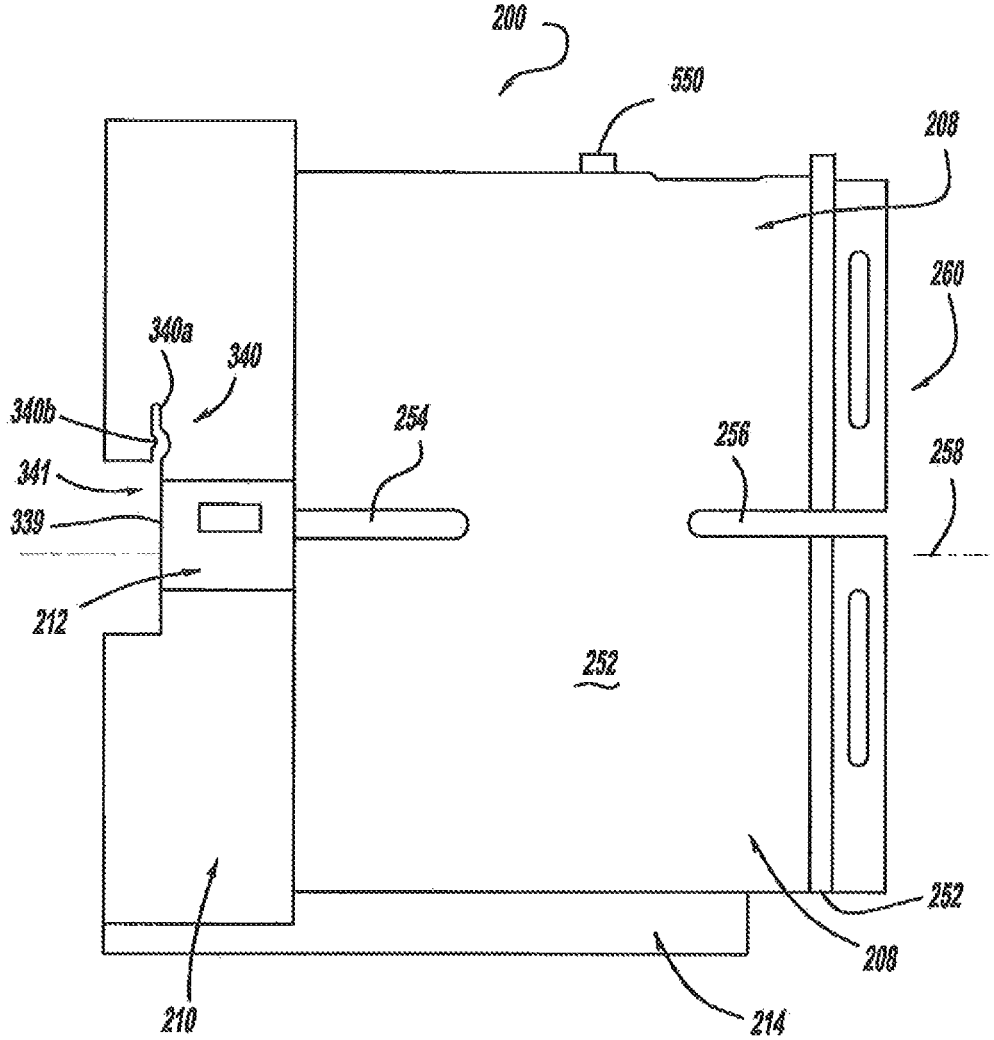
FIG. 5 is side view of a transmission sleeve in accordance with the present teachings.
Figure 8A:
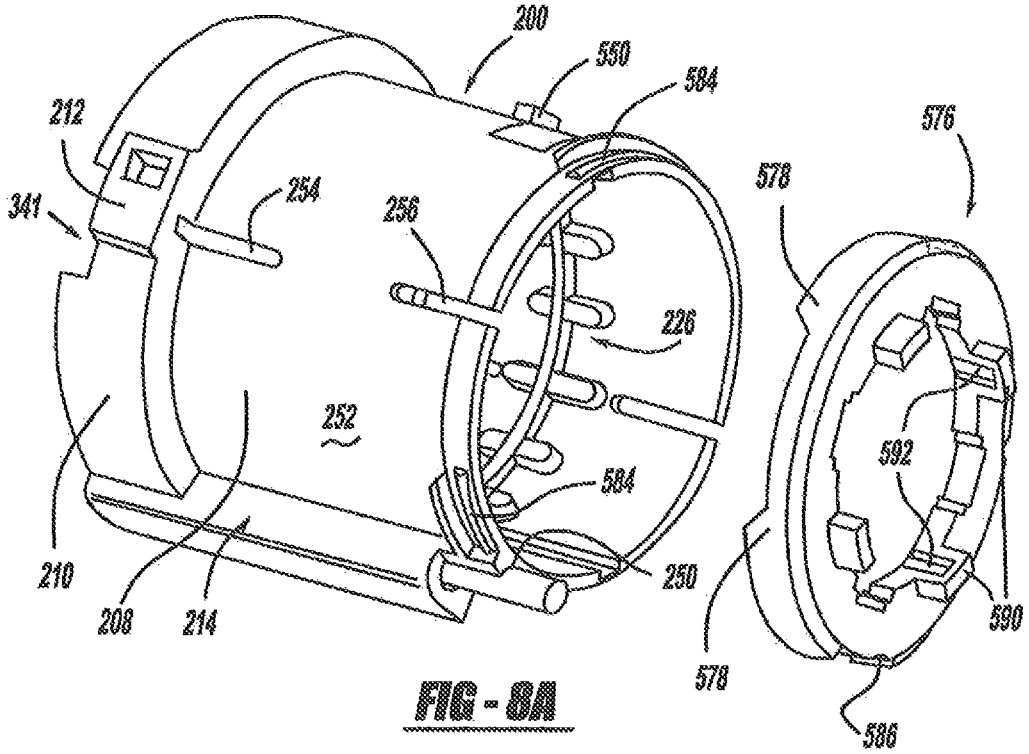
FIG. 8A is a perspective view of the transmission sleeve of FIG. 5 and a cap that may be assembled to a front of the transmission sleeve in accordance with the present teachings.

With reference to FIGS. 5 and 7, the pin housing 214 may extend downwardly from the body 208 and along a majority of the body 208. An actuator aperture 244 may be formed in the pin housing 214 and may extend rearwardly through the base 210 of the transmission sleeve 200. The actuator aperture 244 may be stepped or may taper and may include a first portion 246 with a first diameter at a rear (i.e., left in FIG. 7) of the transmission sleeve 200 and a second portion 248 with a smaller second diameter at a front (i.e., right in FIG. 7) of the transmission sleeve 200. The second portion 248 of the actuator aperture 244 may break through a wall of the second housing portion 229 and may form a groove 250 in an outer surface 252 of the body 208 (also shown in FIG. 8A).

Figure 6:
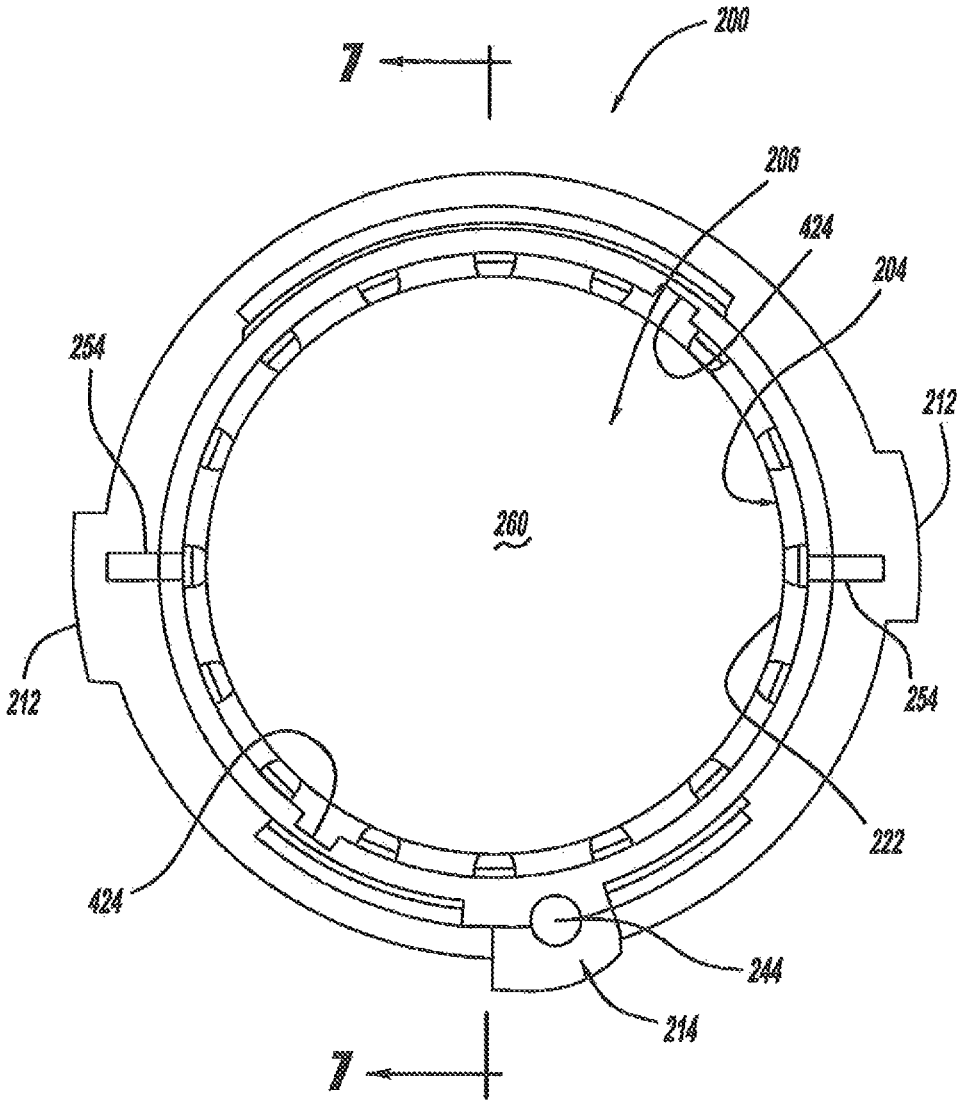
FIG. 6 is a front, view of the transmission sleeve of FIG. 5.

With reference to FIGS. 5, 6 and 7, a pair of first clip slots 254 and a pair of second clip slots 256 may be formed into (or through) the transmission sleeve 200, extending along the sides of the transmission sleeve 200 in a manner that may be generally parallel to a longitudinal axis 258 of the transmission sleeve 200. The first pair of clip slots 254 may be formed through the sides of the body 208 rearwardly of the raised bead 224. The first pair of dip slots 254 may extend rearwardly toward the base 210 or through a portion thereof and may terminate at for near) the bosses 212. The second pair of dip slots 256 may be also formed through the sides of the body 208 beginning forwardly of the raised bead 224 and may extend through (i.e., open to) a front face 260 of the transmission sleeve 200.

Figure 12:
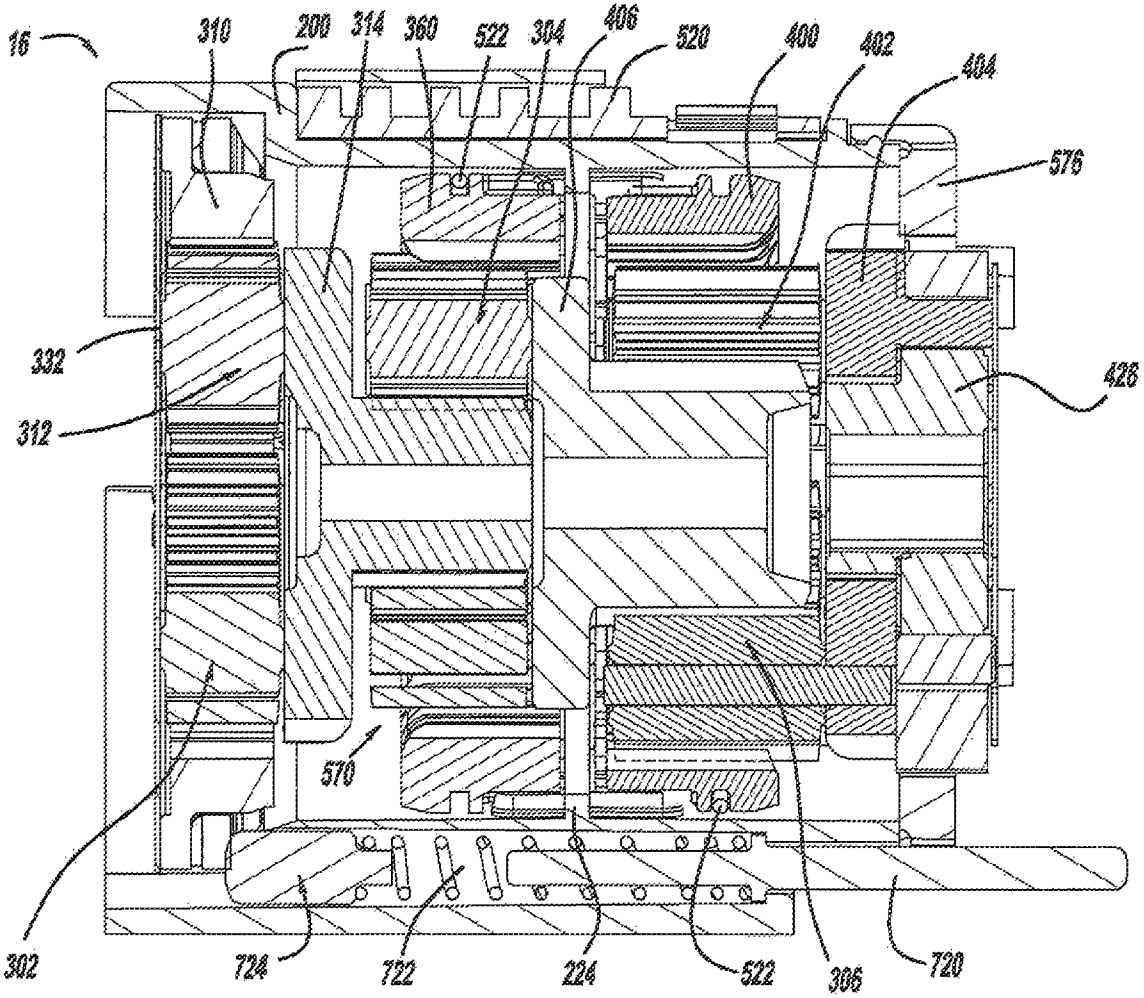
FIG. 12 is a sectional view taken along the longitudinal axis of the transmission of FIG. 2 showing the transmission assembly positioned to provide a first speed ratio in accordance with the present teachings.
Figure 13:
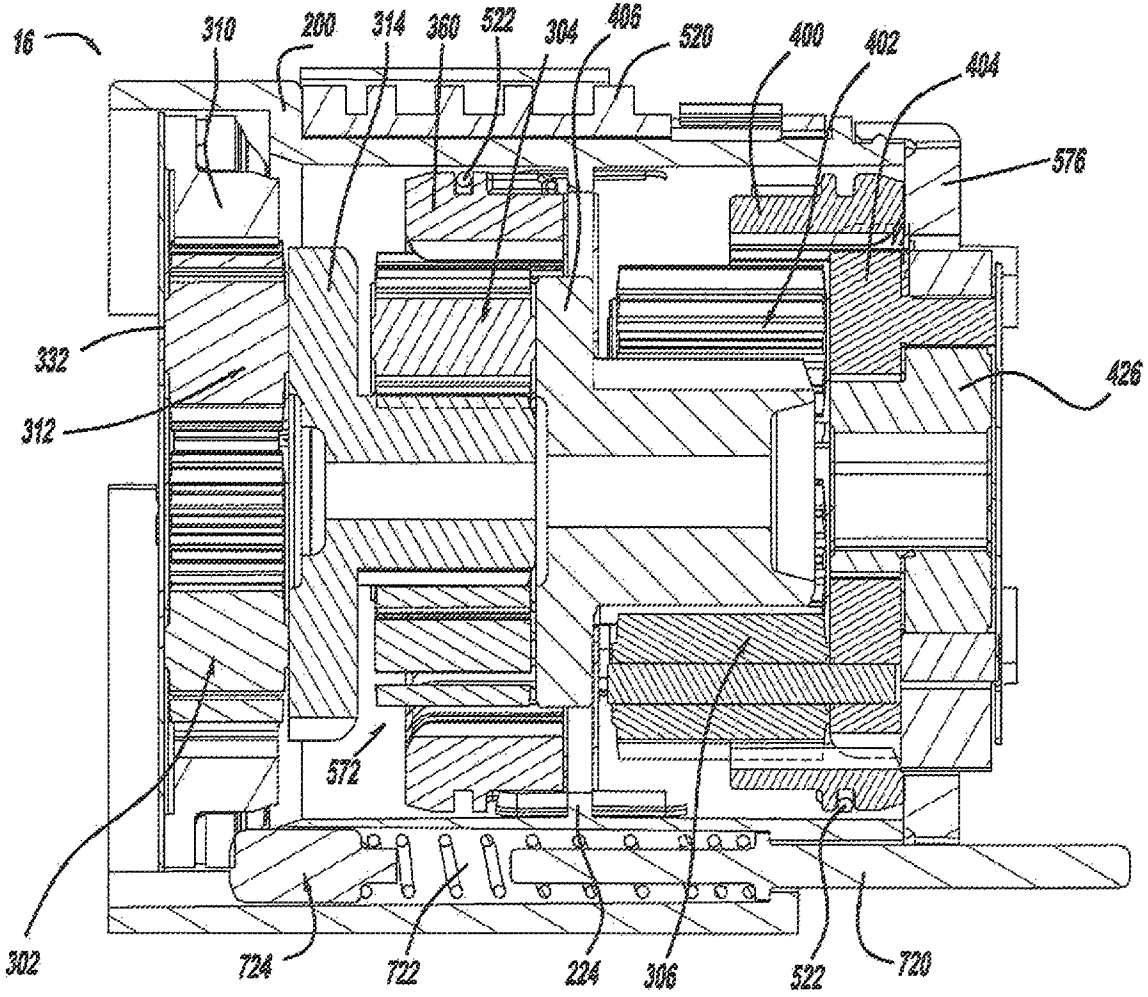
FIG. 13 is a sectional view similar to FIG. 12 and shows the transmission assembly positioned to provide a second speed ratio.
Figure 14:
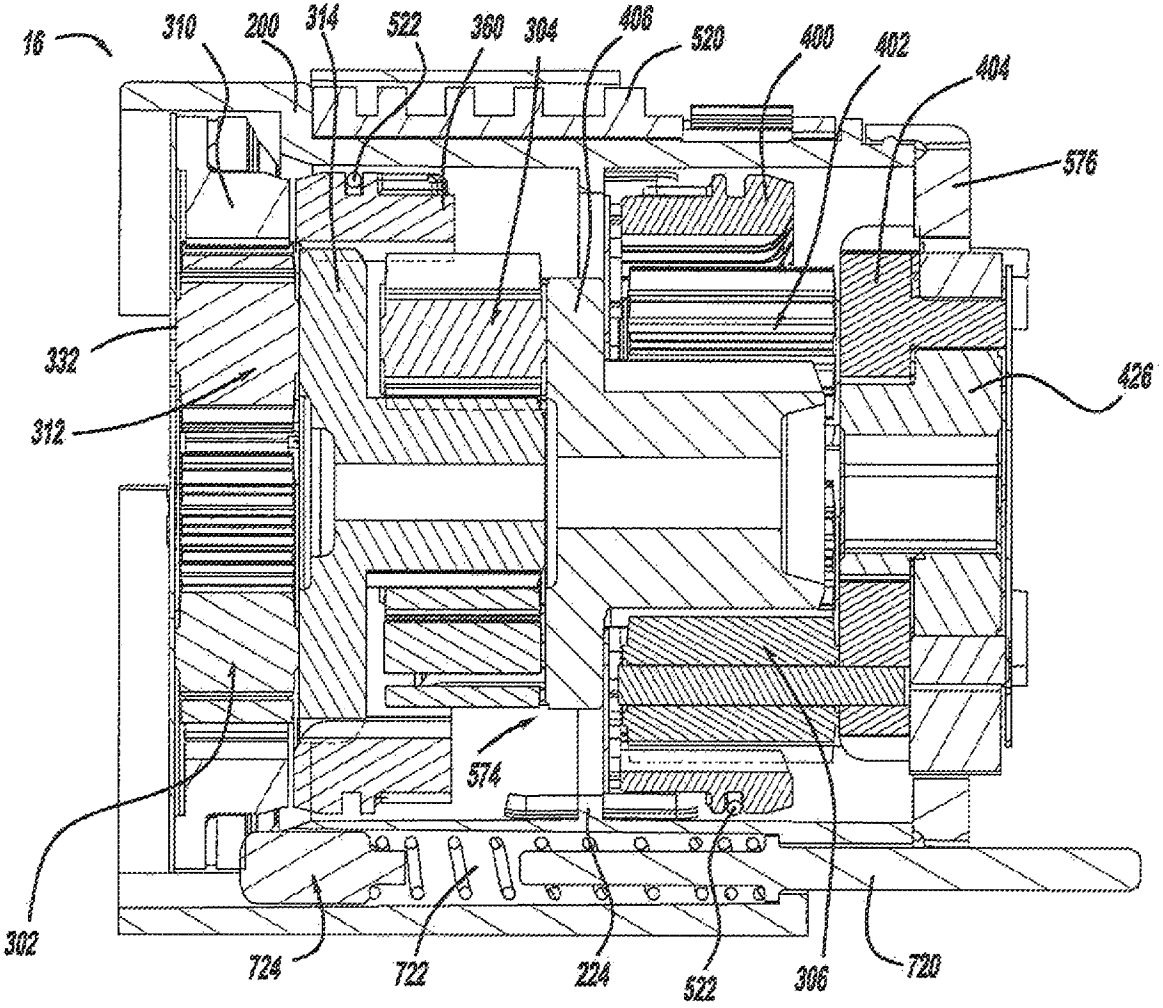
FIG. 14 is a sectional view similar to FIG. 12 and shows the transmission assembly positioned to provide a third speed ratio.

With reference to FIG. 4, the reduction gearset assembly 202 may include a first reduction gear set 302, a second reduction gear set 304 and a third reduction gear set 306. The first, second and third reduction gear sets 302, 304 and 306 may be operable in an active mode, as shown in FIG. 12. The second and third reduction gear sets 304 and 306 may also be operable in an inactive mode. Specifically, FIG. 13 shows the third reduction gearset 306 in the inactive mode and FIG. 14 shows the second reduction gearset 306 in the inactive mode. Operation in the active mode may cause the reduction gear set to perform the speed reduction and torque multiplication operation. In contrast, operation of the reduction gear set in an inactive mode may cause the reduction gear set to provide an output having a speed and torque that may be about equal to the speed and torque of the rotary input provided to that reduction gear set. Each of the first, second and third reduction gear sets 302, 304 and 306 may be planetary gear sets. It will be appreciated that various other types of reduction gear sets are known in the art may be substituted for one or more of the reduction gear sets forming the reduction gear set assembly 202.

The first reduction gear set 302 may include a first reduction element or the first ring gear 310, a first set of planet gears 312 and a first planet or reduction carrier 314. The first ring gear 310 may be an annular structure, having a plurality of gear teeth 310 *a* formed along its interior diameter. A clutch face 316 may be formed from or may be coupled to the front face 318 of the first ring gear 310 and may terminate or be near an outer periphery of the first ring gear 310. The first reduction carrier 314 may be formed in the shape of a flat cylinder, having a plurality of pins 322 that extend from its rearward face 324 (i.e., toward the motor pinion 46). A plurality of gear teeth 314 *a* may be formed into the outer periphery of the first reduction carrier 314. The gear teeth 314 *a* may be formed into the entire outer periphery or a portion thereof, as described in U.S. Pat. No. 6,676,557 already incorporated by reference. In the particular example provided, the total quantity of gear teeth 314 *a* may be reduced by approximately 20% to about 35% relative to a quantity of gear teeth that could be formed on the outer periphery of the first reduction carrier 314.

Figure 9A:
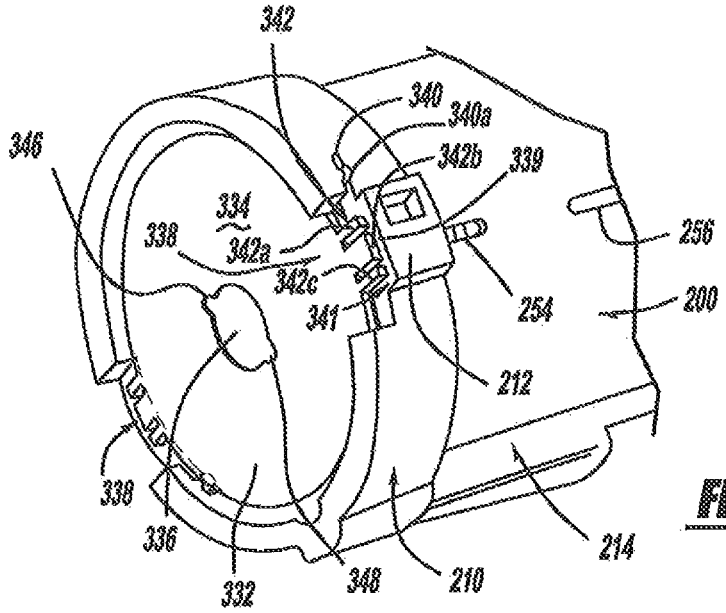
FIG. 9A is a perspective view of the transmission sleeve of FIG. 5 and a thrust washer that is assembled to a rear of the transmission sleeve in accordance with the present teachings.

With reference to FIGS. 9A and 98, the first thrust washer 332 and the transmission sleeve 200 may be configured to cooperate with one another to permit the first thrust washer 332 to be fixedly but removably coupled to the transmission sleeve 200 in a robust and reliable manner. In the example provided, the first thrust washer 332 may have a circular planar portion 334, a central aperture 336 and a plurality of retaining tabs 338. Each retaining tab 338 may include a plurality of fingers 342 which may be disposed in a common plane when the thrust washer 332 has not been installed to the transmission sleeve 200.

The transmission sleeve 200 may be configured so as to define a pair of mounts 339 that may be located proximate the bosses 212. Each mount 339 may include a void space 341, which may be configured to receive an associated retaining tab 338 when the thrust washer 332 may be axially received into the base 210, as well as a clamping portion 340. Each clamping portion 340 may include a circumferentially extending slot 340 *a*, which may intersect one of the void spaces 341 and a stop member 340 *b*. In the particular example provided, the stop member 340 *b* may be a bump or protrusion that extends into the slot 340 *a* and which may be sized relatively smaller than a distance between two of the fingers 342 of the retaining tabs 338 of the thrust washer 332. Accordingly, when the thrust washer 332 is secured to the transmission sleeve 200, rotation of the thrust washer 332 may cause a first one of the fingers 342 to resiliently deflect and ride over the stop member 340 *b*. Alignment of the gap between the fingers 342 to the stop member 340 *b* may operably resist movement of the thrust washer 332 relative to the transmission sleeve 200. Alternatively, the stop member 340 *b* may engage the one of the fingers 342 to secure the thrust washer 332 to the transmission sleeve 200.

To aid in assembling the thrust washer 332 to the transmission sleeve 200, the central aperture 336 may be formed in a non-circular manner. Accordingly, a correspondingly shaped tool (not shown) may be inserted into the central aperture 336 and employed to transmit drive torque to the thrust washer 332 to cause the thrust washer 332 to rotate within the base 210 of the transmission sleeve 200.

With reference to FIG. 4, the second reduction gear set 304 may be disposed within the portion of the hollow cavity 206 defined by the first housing portion 227 and may include a second sun gear 358, a second reduction element or ring gear 360, a second set of planet gears 362 and a second planet or reduction carrier 364. It will be appreciated that the motor pinion 46 may serve as a sun gear for the first reduction gearset 302. The second sun gear 358 may be fixed for rotation with the first reduction carrier 314. The second sun gear 358 may include a plurality of gear teeth 358 *a* that may extend forwardly (i.e., away from the motor pinion 46) of the forward face 328 of the first reduction carrier 314.

The second ring gear 360 may be an annular structure, having a plurality of gear teeth 360 *a* formed along an interior surface associated with its inner diameter. The second reduction gearset 304 may include the second reduction carrier 364 having a plurality of pins 366 holding the second set of planet gears 362. The gear teeth 360 *a* formed along the interior diameter of the second ring gear 360 and, among other things, their engagement with the planet gears 362 on the second reduction carrier 364 are outside the scope of the present disclosure but are discussed in further detail in one or more of the captioned references already incorporated by reference above.

A plurality of sleeve engagement teeth 368 may be formed into an outer periphery of the second ring gear 360. The sleeve engagement teeth 368 may extend forwardly (i.e., away from the motor spindle 46) toward a front face 370 of the second ring gear 360 and may terminate at a tip portion 372 that may be rounded and may taper forwardly and/or inwardly. An annular clip groove 374 may also formed in the outer periphery of the second ring gear 360, The clip groove 374 may be formed as a generally rectangular slot having a pair of sidewalls that may hold a portion of a wire clip 522 discussed below.

The third reduction gear set 306 may be disposed within the portion of the hollow cavity 206 defined by the second housing portion 229 and may include a third sun gear 398, a third reduction element or ring gear 400, a third set of planet gears 402 and a third planet or reduction carrier 404. The third sun gear 398 may be fixed for rotation with the second reduction carrier 364 and may include a plurality of gear teeth 398 *a* that may be meshingly engaged to the third set of planet gears 402. The third planet carrier 404 may be generally similar to the first planet carrier 314 and may be employed to journal the third set of planet gears 402. A plurality of gear teeth 404 *a* may be formed into the outer periphery of the third reduction carrier 404. The gear teeth 404 *a* may be formed into the entire outer periphery or a portion thereof, as described in U.S. Pat. No. 6,676,557 already incorporated by reference. In the particular example provided, the total quantity of gear teeth 404 *a* may be reduced by approximately 20% to about 35% relative to a quantity of gear teeth that could be formed on the outer periphery of the third reduction carrier 404.

The third ring gear 400 may be an annular structure having a plurality of gear teeth 400 *a* formed along its inner periphery associated with an interior diameter. The engagement of the gear teeth 400 *a* with the planet gears 402 is outside the scope of the present disclosure but is discussed in further detail in the referenced disclosures already incorporated by reference above.

A plurality of sleeve engagement teeth 412 may be formed into the outer periphery of the third ring gear 400. The sleeve engagement teeth 412 may extend rearward toward the rear face 414 of the third ring gear 400 and may terminate at a tip portion 416, each of which may be rounded and/or may taper rearwardly and/or inwardly. An annular clip groove 418 may also be formed into the outer periphery of the third ring gear 400. The clip groove 418 may be formed as a generally rectangular slot having a pair of sidewalls that may hold a portion of a wire clip 522 discussed below.

A second thrust washer 420 may be disposed around the third sun gear 398 between the third ring gear 400 and the second ring gear 360. The second thrust washer 420 may include a plurality of retaining tabs 422 that may be configured to engage corresponding tab grooves 424 that may be formed in the inner surface 222 of body 208 of the transmission sleeve 200, as illustrated in FIG. 7. The retaining tabs 422 and the tab grooves 424 (FIG. 7) may cooperate to inhibit relative rotation between the second thrust washer 420 and the transmission sleeve 200.

Figure 22A:
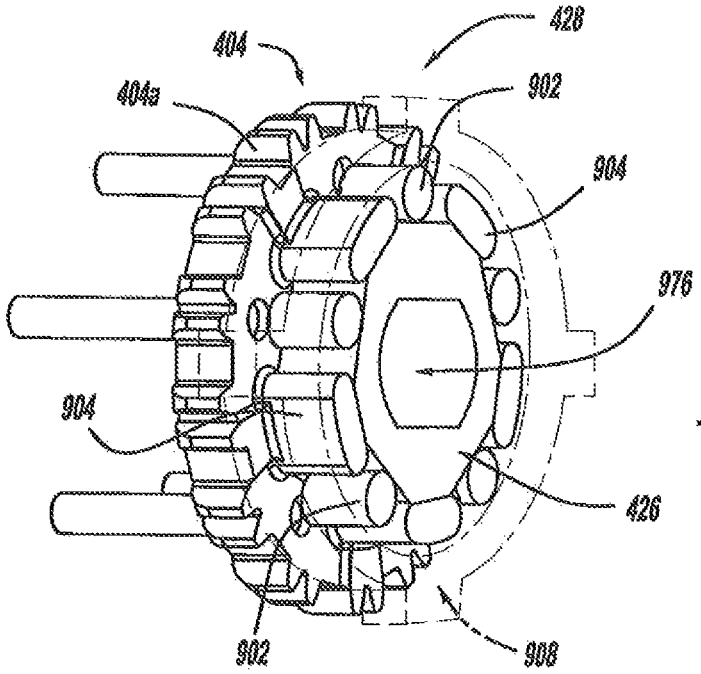
FIG. 22A is a perspective view of a planet carrier, an anvil and a portion of a spindle lock assembly in accordance with the present teachings.
Figure 22B:
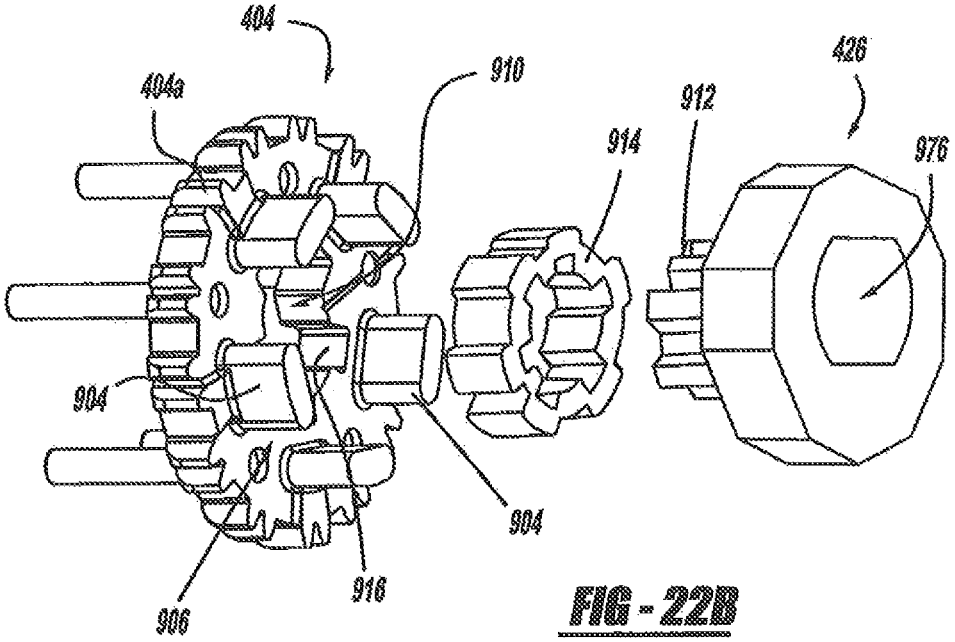
FIG. 22B is an exploded assembly view of the planet carrier, the anvil and the portion of the spindle lock assembly of FIG. 22A and shows an anvil-specific gasket between the anvil and the planet carrier.

With reference to FIGS. 4, 22A and 22B, the output spindle assembly 20 may include an anvil 426 that may be part of a spindle lock assembly 428 or a one-way clutch. The anvil 426, which is discussed in further detail below, may couple an output spindle 430 associated with the output spindle assembly 20 (FIG. 3) to the third reduction carrier 404 so as to transmit drive torque from the reduction gearset assembly 202 to ultimately the chuck 22 (FIG. 1).

Figure 10:
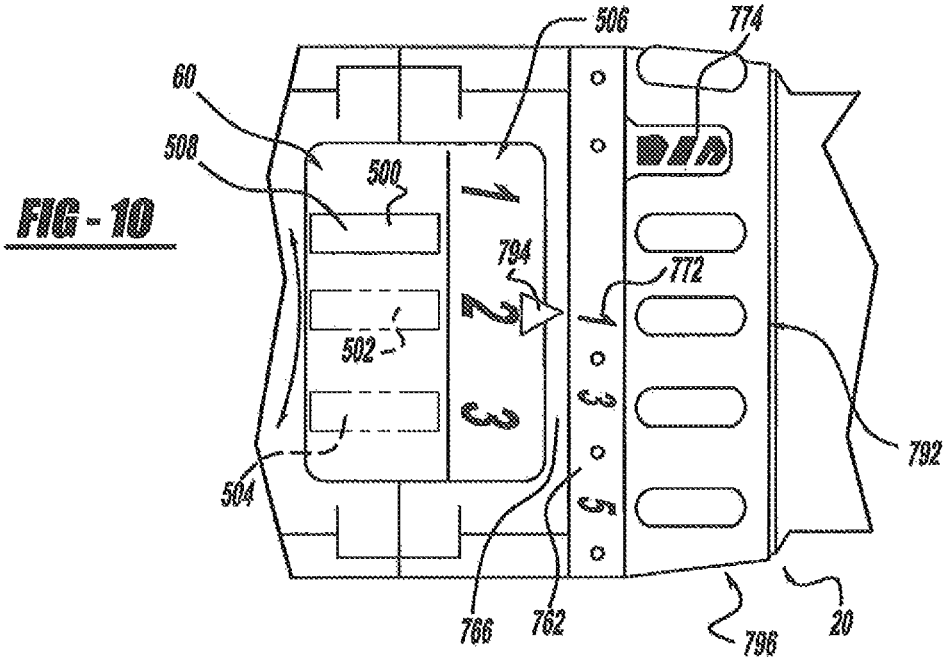
FIG. 10 *a* is a top view of a speed selector mechanism and an adjuster mechanism assembled to a housing and showing positions that correspond to different speed ratios of the power tool in accordance with the present teachings.

With reference to FIGS. 3, 4 and 10, the speed selector mechanism 60 may be movable between a first position 500, a second position 502 and a third position 504, as shown in FIG. 10. The speed selector mechanism 60 may include a switch body 506 having an actuator portion 508 for receiving a speed change input and for connecting to a rotary selector cam 520. The actuator portion 508 may be operatively coupled to the reduction gearset assembly 202 and ultimately may be used to move the second and third reduction gear sets 304 and 306 between the active and inactive modes in response to movement of the actuator portion 508 between the first, second and third positions 500, 502 and 504.

The speed selector mechanism 60 may include the rotary selector cam 520, a plurality of wire clips 522 and a spring member 523. Each of the wire clips 522 may be formed from a round or other suitable wire which may be bent in the shape of a semi-circle 524 with a pair of tabs 526 extending outwardly from the semi-circle 524 and positioned on about the centerline of the semi-circle 524. The semi-circle 524 may be sized to fit within the clip grooves 374 and 418 in the second and third ring gears 360 and 400, respectively. The tabs 526 of the wire clips 522 may extend outwardly of the hollow cavity 206 into an associated one of the clip slots 254, 256 that may be formed into the transmission sleeve 200. The tabs 526 may be long enough so that they may extend outwardly of the outer surface 252 of the body 208 of the transmission sleeve 200, but not so far as to extend radially outward of a periphery of the base 210 of the transmission sleeve 200. Configuration of the wire clips 522 in this manner may facilitate the assembly of the transmission assembly 16 and may permit the wire clips 522 to be installed on the second and third ring gears 360 and 400. After assembly and installation, these assemblies may be inserted into the hollow cavity 206 along the longitudinal axis 258 (FIG. 5) of the transmission sleeve 200.

Figure 11:
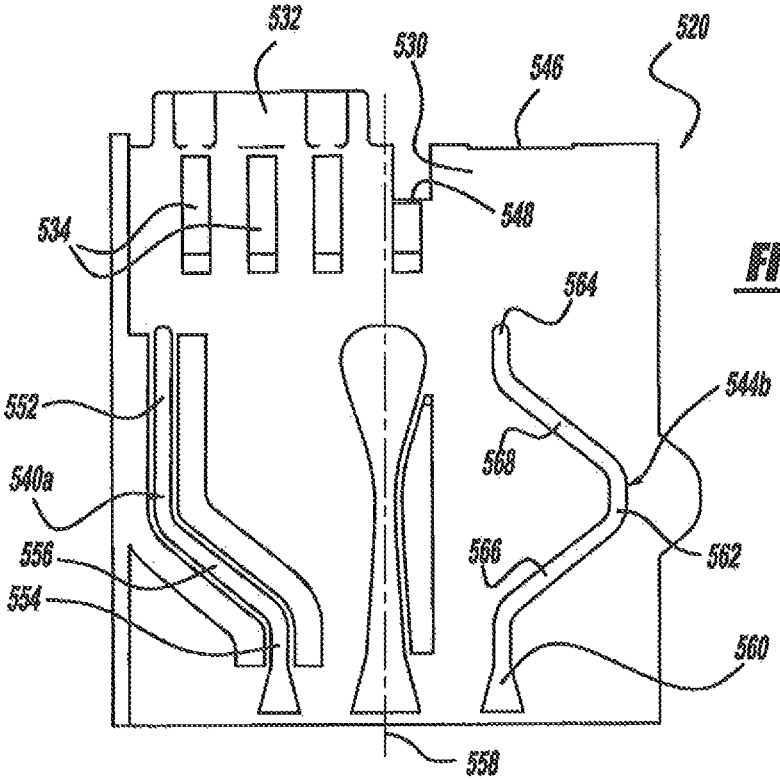
FIG. 11 is a perspective view of the rotary selector cam in accordance with the present teachings.

With specific reference to FIG. 11, the rotary selector cam 520 may include an arcuate selector body 530 (also shown in FIG. 4), a switch tab 532 and a plurality of spacing members 534. A pair of first cam slots 540 *a* and 540 *b*, a pair of second cam slots 544 *a* and 544 *b*, a spring aperture 546 and a guide aperture 548 may be formed through the selector body 530. The selector body 530 may be sized to engage the outside diameter of the body 208 of the transmission sleeve 200 in a slip-fit manner, but still rotate relative thereto.

With reference to FIGS. 2, 4, 11 and 12, the guide aperture 548 may be generally rectangular in shape and sized to engage the front and rear surfaces of the selector cam guide 550 (FIG. 5). The guide aperture 548 may be considerably wider than the width of the selector cam guide 550 and may be sized in this manner to permit the rotary selector cam 520 to be rotated on the transmission sleeve 200 between a first rotational position 500, a second rotational position 502 and a third rotational position 504. The selector cam guide 550 may cooperate with the guide aperture 548 to limit the amount by which the rotary selector earn 520 may be rotated on the transmission sleeve 200. In this regard, a first lateral side of the selector cam guide 550 may contact a first lateral side of the guide aperture 548 when the rotary selector cam 520 may be positioned in the first rotational position 500. A second lateral side of the selector cam guide 550 may contact a second lateral side of the guide aperture 548 when the rotary selector cam 520 may be positioned in the third rotational position 504.

With specific reference to FIG. 11, each of the first cam slots 540 *a* and 540 *b* may be sized to receive one of the tabs 526 of the wire clip 522 that may be engaged to the second ring gear 360. The first cam slot 540 *a* may include a first segment 552, a second segment 554 and an intermediate segment 556. The first segment 552 may be located a first predetermined distance away from a reference plane 558, which may be perpendicular to the longitudinal axis of the rotary selector cam 520. The second segment 554 may be located a second distance away from the reference plane 558. The intermediate segment 556 may couple the first and second segments 552 and 554 to one another. The configuration of first cam slot 540 *b* may be identical to that of first cam slot 540 *a*, except that it may be rotated relative to the rotary selector cam 520 such that each of the first, second and intermediate segments 552, 554 and 556 in the first cam slot 540 *b* may be located one hundred eighty degrees apart from the first, second and intermediate segments 552, 554 and 556 in the first cam slot 540 *a*.

Each of the second cam slots 544 *a* and 544 *b* may be sized to receive one of the tabs 526 of a corresponding one of the wire clips 522. The second cam slot 544 *a* may include a first segment 560, a second segment 562, a third segment 564 and a pair of intermediate segments 566 and 568. The first and third segments 560 and 564 may be located a third predetermined distance away from the reference plane 558 and the second segment 562 may be located a fourth distance away from the reference plane 558. The intermediate segment 566 may couple the first and second segments 560 and 562 to one another and the intermediate segment 568 may couple the second and third segments 562 and 564 together.

In one aspect of the present teachings, the first segment 552 may be closed at one end of the rotary selector cam 520, which may be shown to improve the structural rigidity of the rotary selector cam 520. As such, the first segment 552, the intermediate segment 556 and the second segment 554 may form a closed channel 552 *a* such that the wire clip 522 may travel within the channel 552 *a* but may not travel outside the channel 552 *a* once inserted into the channel 552 *a*. The configuration of second cam slot 544 *b* may be identical to that of second cam slot 544 *a*, except that it may be rotated relative to the rotary selector cam 520 such that each of the first, second, third and intermediate segments 560, 562, 564 and 566 and 568 in the second cam slot 544 *b* may be located one hundred eighty degrees apart from the first, second, third and intermediate segments 560, 562, 564 and 566 and 568 in the second cam slot 544 *a*.

With the tabs 526 of the wire clips 522 engaged to the first cam slots 540 *a* and 540 *b* and the second cam slots 544 *a* and 544 *b*, the rotary selector cam 520 may be rotated on the transmission sleeve 200 between the first, second and third positions 500, 502 and 504 (FIG. 10) to selectively engage and disengage the second and third ring gears 360 and 400 from the first and third reduction carriers 364 and 404, respectively. During the rotation of the rotary selector cam 520, the first cam slots 540 *a* and 540 *b* and the second cam slots 544 *a* and 544 *b* may confine the wire tabs 526 of their associated wire clip 522 and may cause the wire tabs 526 to travel along the longitudinal axis 258 (FIG. 5) of the transmission sleeve 200 in an associated one of the first and second clip slots 254 and 256. Accordingly, the rotary selector cam 520 may be operative for converting a rotational input to an axial output that may cause the wire clips 522 to move axially in the predetermined manner explained above.

With reference to FIGS. 3, 4, 10, 11 and 12, positioning the rotary selector cam 520 in the first rotational position 500 may cause the tabs 526 of the wire clip 522 that may be engaged to the second ring gear 360 to be positioned in the first segment 552 of the first cam slots 540 *a* and 540 *b*. The tabs 526 of the wire clip 522 that may be engaged to the third ring gear 400 may be positioned in the first segment 560 of the second cam slots 544 *a* and 544 *b*. Accordingly, positioning of the rotary selector cam 520 in the first rotational position may cause the second and third ring gears 360 and 400 to be positioned in meshing engagement with the second and third planet gears 362 and 402, respectively. Simultaneously with the meshing engagement of the second and third ring gears 360 and 400 with the second and third planet gears 362 and 402, the sleeve engagement teeth 368 and 412 of the second and third ring gears 360 and 400, respectively may be positioned in meshing engagement with the first and second sets of ring engagement teeth 218 and 220. The meshing engagement may inhibit relative rotation between the second and third ring gears 360 and 400 and the transmission sleeve 200 and thereby may provide the transmission assembly 16 with a first overall gear reduction or speed ratio 570, as shown in FIG. 12.

As explained above, the first set 236 of teeth 226 may be longer and/or may be offset longitudinally from the second set 238 of teeth 226, which may be shown to ease engagement of the second and/or third ring gears 360, 400.

With reference to FIGS. 3, 4, 10, 11 and 13, positioning the rotary selector cam 520 in the second rotational position 502 may cause the tabs 526 of the wire clip 522 that may be engaged to the second ring gear 360 to be positioned in the first segment 550 of the first cam slots 540 *a* and 540 *b*. The tabs 526 of the wire clip 522 may be engaged to the third ring gear 400 and may be positioned in the second segment 562 of the second cam slots 544 *a* and 544 *b*. Accordingly, positioning of the rotary selector cam 520 in second rotational position 502 causes the second ring gear 360 to be in meshing engagement with the second planet gears 362 and the third ring gear 400 in meshing engagement with both the third planet gears 402 and the third reduction carrier 404. Positioning of the rotary selector cam 520 in the second rotational position 502 may also position the sleeve engagement teeth 368 of the second ring gear 360 in meshing engagement with the first set of ring engagement teeth 218, while the sleeve engagement teeth 412 of the third ring gear 400 may not be engaged (not meshed) with the second set of ring engagement teeth 220. As such, relative rotation between the second ring gear 360 and the transmission sleeve 200 may be inhibited, while relative rotation between the third ring gear 400 and the transmission sleeve 200 may be permitted to thereby provide the transmission assembly 16 with a second overall gear reduction or speed ratio 572, as illustrated in FIG. 13.

With reference to FIGS. 3, 4, 10, 11 and 14, positioning the rotary selector cam 520 in the third rotational position 504 may cause the tabs 526 of the wire clip 522 that may be engaged to the second ring gear 360 to be positioned in the second segment 552 of the first cam slots 540 *a* and 540 *b*. The tabs 526 of the wire clip 522 may be engaged to the third ring gear 400 and may be positioned in the third segment 564 of the second cam slots 544 *a* and 544 *b*. Accordingly, positioning of the rotary selector cam 520 in the third rotational position 504 may cause the second ring gear 360 to be in meshing engagement with both the second planet gears 362 and the first reduction carrier 314, while the third ring gear 400 in meshing engagement with only the third planet gears 402. Positioning the rotary selector cam 520 in the third rotation position 504 may also position the sleeve engagement teeth 368 on the second ring gear 360 out of meshing engagement with the first set of ring engagement teeth 218 and the sleeve engagement teeth 412 on the third ring gear 400 in meshing engagement with the second sets of ring engagement teeth 220. In this regard, relative rotation between the second ring gear 360 and the transmission sleeve 200 may be permitted while, relative rotation between the third ring gear 400 and the transmission sleeve 200 may be inhibited to thereby provide the transmission assembly 16 with a third overall gear reduction or speed ratio 574, as shown in FIG. 14.

It will be appreciated that friction associated with the sliding engagement of the second and third ring gears 360 and 400 with the first and third reduction carriers 314 and 404, respectively, when the second and third reduction gear sets 304 and 306, respectively, may be activated or may be inactivated could hinder shifting of the reduction gearset assembly 202. The reduction in the number of gear teeth on the first and third reduction carriers 314 and 404 may be shown to reduce this friction characteristic so that the reduction gearset assembly 202 may be relatively easier to shift.

Additional details of the rotary selector cam 520 are outside the scope of the present disclosure but are disclosed in further detail in the above referenced disclosures already incorporated by reference above. It will be appreciated that the rotary selector cam 520 (i.e., the first cam slots 540 *a* and 540 *b* and the second cam slots 544 *a* and 544 *b*) could be configured somewhat differently so as to cause the second ring gear 360 to engage (mesh with) both the second planet gears 362 and the first reduction carrier 314, while the third ring gear 400 may engage (mesh with) both the third planet gears 402 and the third reduction carrier 404 to thereby provide the transmission assembly 16 with a fourth overall gear reduction or speed ratio.

Figure 8B:
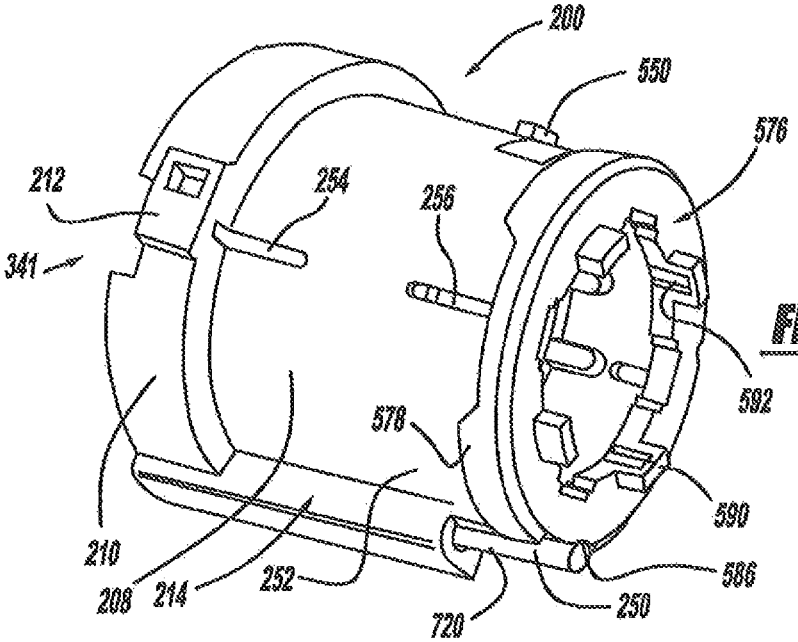
FIG. 8B is similar to FIG. 8A and shows the cap assembled to the transmission sleeve in accordance with the present teachings.
Figure 8C:
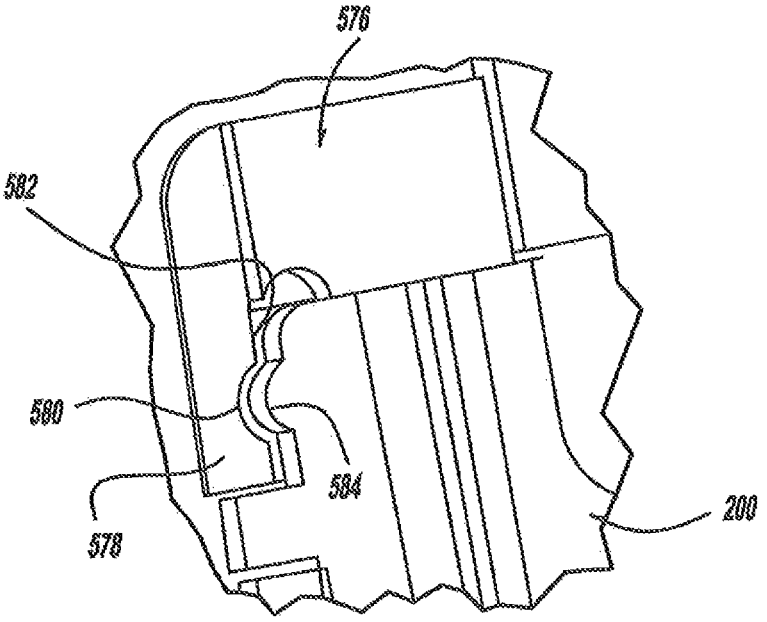
FIG. 8C shows a detailed assembly view of the cap and the transmission sleeve of FIG. 8B.
Figure 8D:
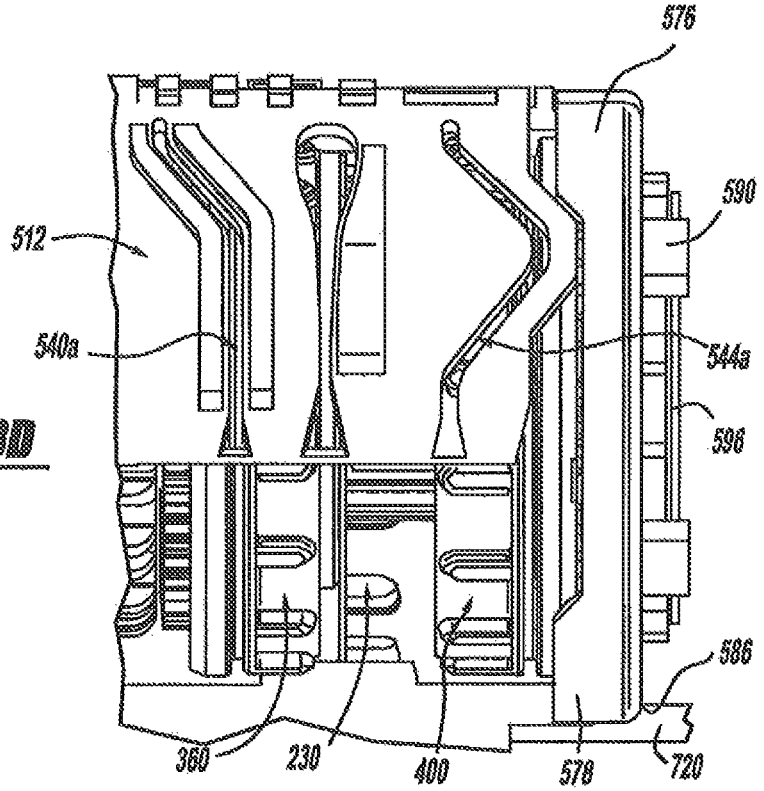
FIG. 8D is a side view of the annular flanges of the cap of the transmission sleeve configured to not interfere with motion of a rotary selector cam.

With reference to FIGS. 4, 8A, 8B and 8C, a cover 576 may connect to the transmission sleeve 200 on a side opposite the base 210. The cover 576 may be attached to the transmission sleeve 200 via a snap-fit. Specifically, the cover 576 may include an annular flange 578 that may include a groove 580 (FIG. 8C) formed within an inner surface 582 of the annular flange 578. The annular flange 578 may be configured in multiple separate sections so as not to interfere with the rotary cam selector 520 (as shown in FIG. 8D), as it moves between positions relative to the transmission sleeve 200. With reference to FIG. 8C, the groove 580 formed on the inner surface 582 of the annular flange 578 may receive a circumferentially extending raised bead or rib 584 formed on the outer surface 252 of the transmission sleeve 200. The raised bead or rib 584 may be integral to or may be coupled to the transmission sleeve 200 and may form a complete annular structure or may otherwise be a plurality of sections. By snapping the cover 576 onto the transmission sleeve 200, the groove 580 formed on the inner surface 582 of the annular flange 578 may snap over and thus may receive the bead 584 formed on the transmission sleeve 200.

With reference to FIGS. 8A-8D, an indentation 586 that may be formed on the cover 576 at one or more locations may receive a portion of the clutch engagement assembly 702 (i.e., a clutch pin) as discussed in further detail below. By receiving (or indexing against) a body portion 730 (FIG. 15) of a pin member 720, which may be part of the engagement assembly 702 in the clutch mechanism 18 (FIG.

15) discussed in further detail below, the cover 576 may be installed onto the transmission sleeve 200 at one or more preselected orientations. As such, it may be shown that an improper installation orientation may be prevented. As illustrated, the cover 576 may be assembled to the transmission sleeve 200 in two orientation-specific positions. In both aforesaid positions, the cover 576 may index against a portion of the engagement assembly 702. Moreover, when the cover 576 may be secured to the transmission sleeve 200, the cover 576 and more specifically the annular flange 578 may not interfere, with the movement of the rotary selector cam 520. It will be appreciated that in other examples the cover 576 may have one or a plurality of indexing positions and an associated configuration of the annular flanges that do not interfere with the rotary selector cam 520.

Figure 9B:
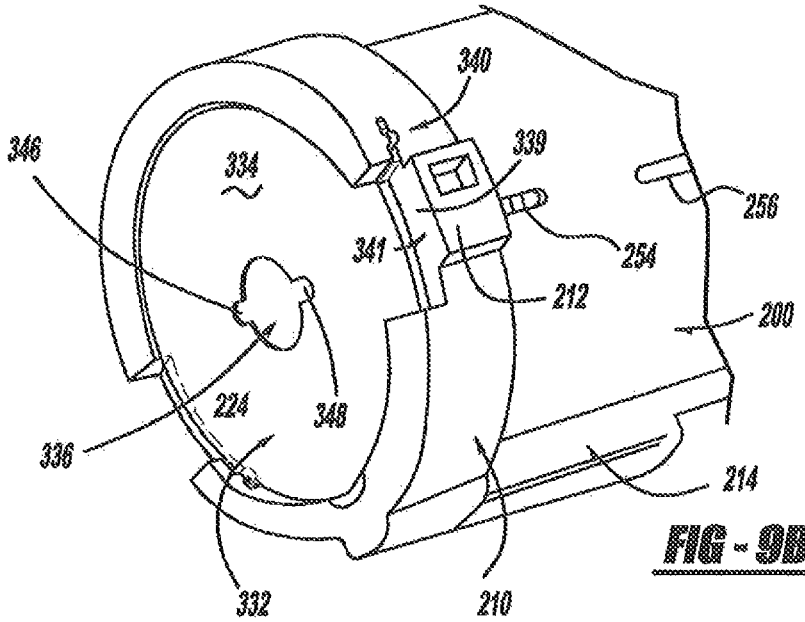
FIG. 9B is similar to FIG. 9A and shows the thrust washer secured to the transmission sleeve in accordance with the present teachings.

With reference to FIGS. 8B and 9B the thrust washer 332 may be attached to the rear portion of the transmission sleeve 200 (near the motor pinion 46) and the cover 576 may be snap-fit to the front of the transmission sleeve 200. In this regard, the transmission components (i.e., the first, second and/or third reduction sets among other things) may be contained within the transmission sleeve 200 as a self-contained unit or a transmission cassette 588 (FIG. 2). It will be appreciated that the transmission cassette 588 may be removed from the tool housing 12 as a self-contained unit and thus the propensity of the various transmission components falling out of the transmission sleeve 200 may be shown to be reduced.

With reference to FIGS. 3, 4 and 8B, the cover 576 may also include a plurality of raised bosses 590 formed on the front face of the cover that may include apertures 592 that may receive tangs 594 formed on a front washer 596. The front washer 596 may be part of the spindle lock assembly 428. The front washer 596 may have an aperture 598 formed in generally the middle of the front washer 596. The output spindle 430 that may be associated with the output spindle assembly 20 may be received by the anvil 426 through the front washer 596.

Figure 15:
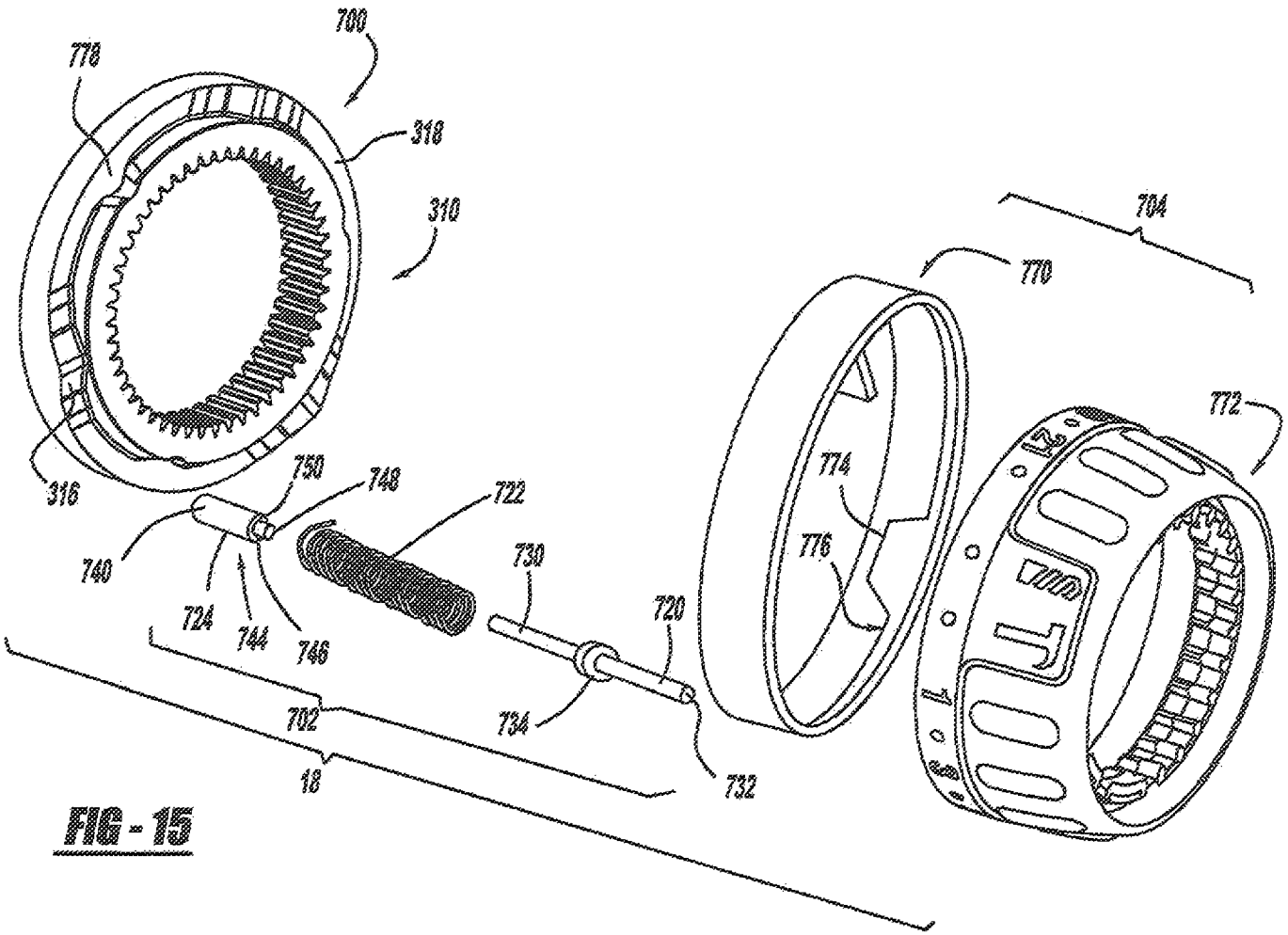
FIG. 15 is an exploded assembly view of an adjustable clutch mechanism in accordance with the present teachings.
Figure 16:
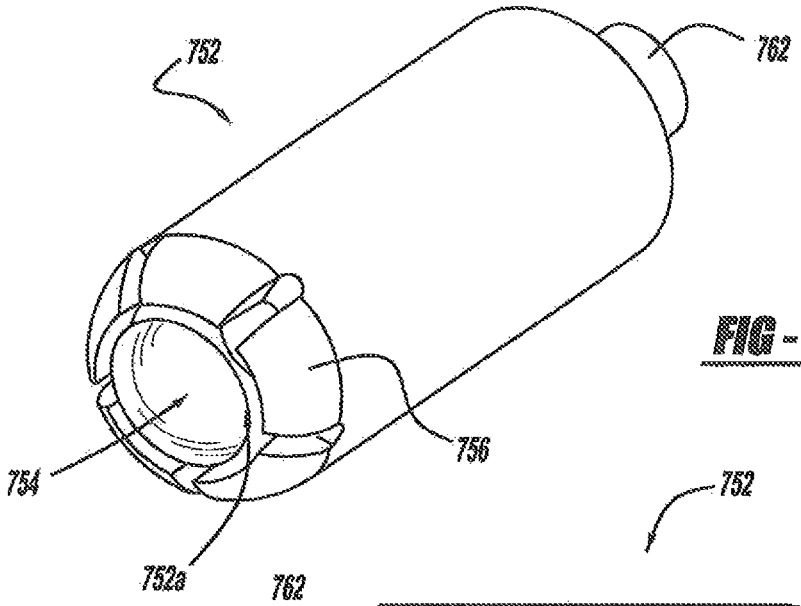
FIG. 16 is a perspective view of an exemplary alternative tip portion of a clutch pin from the clutch assembly of FIG. 15 showing a ball catch in accordance with the present teachings.
Figure 16A:
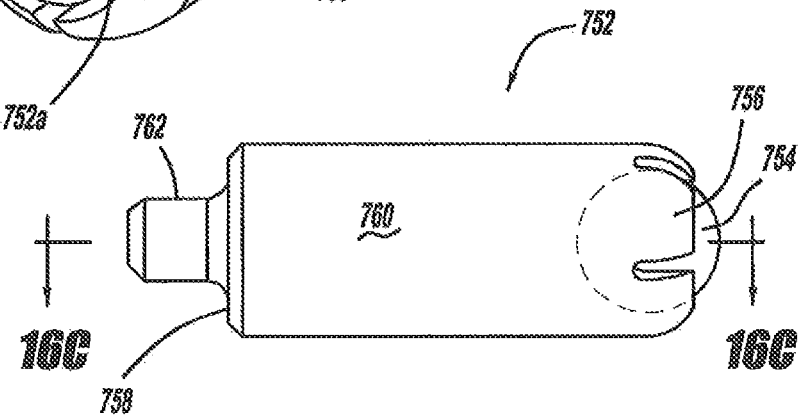
FIG. 16A is a side view of the tip portion of FIG. 16.
Figure 16B:
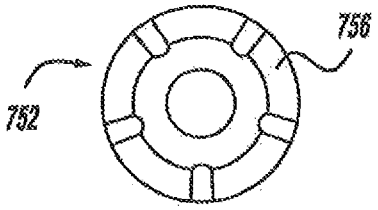
FIG. 16B is front view of the tip portion of FIG. 16.
Figure 16C:
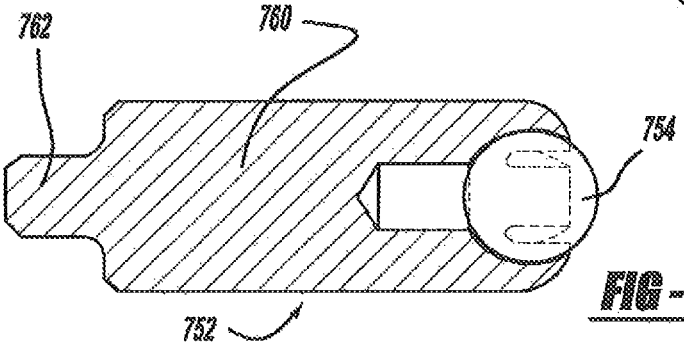
FIG. 16C is a cross-section view taken through FIG. 16A.
Figure 17:
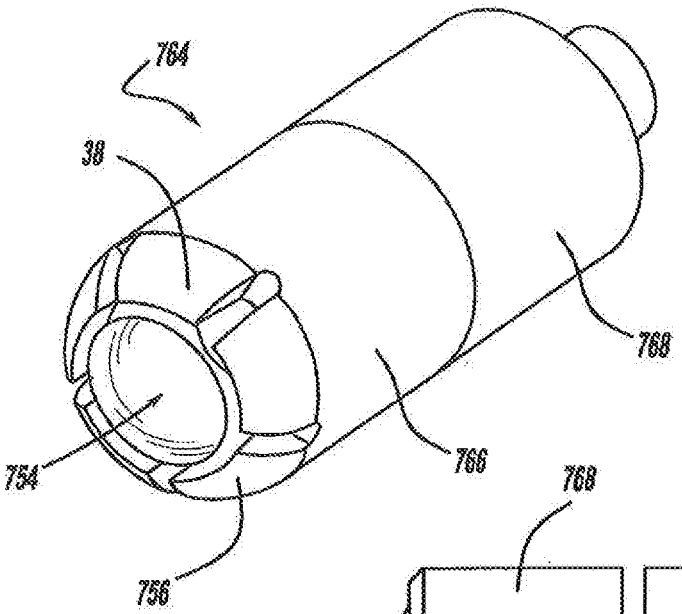
FIGS. 17, 17A, 17B and 17C are similar to FIGS. 16, 16A, 16B and 16C, respectively, and show an exemplary alternative tip portion having a two-piece construction in accordance with the present teachings.
Figure 17A:
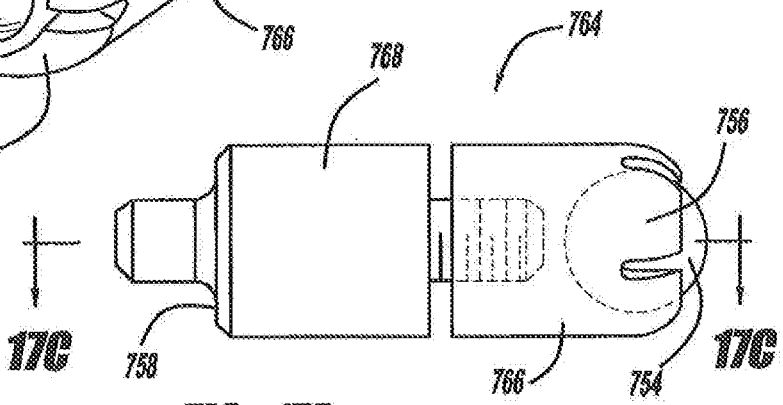
Figure 17B:
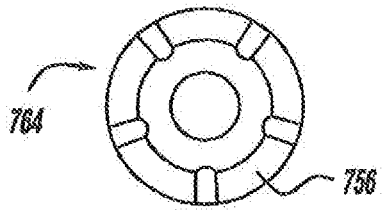
Figure 17C:
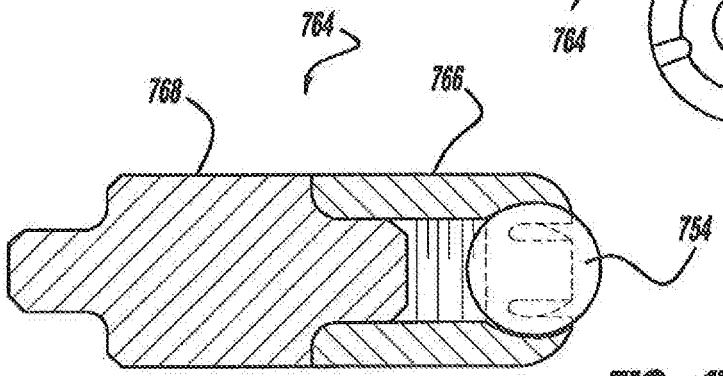

With reference to FIGS. 4 and 15, the clutch mechanism 18 may include a clutch member 700, an engagement assembly 702 and an adjustment mechanism 704. The clutch member 700 may be an annular structure that may be fixed to the outer diameter of the first ring gear 310 and which may extend radially outward therefrom away from the motor pinion 46). The clutch member 700 may include the clutch face 316 that may be formed into the front axial face 318 of the first ring gear 310. The outer periphery of the clutch member 700 may be sized to rotate within the portion of the hollow cavity 206 that may be defined by the base 210 of the transmission sleeve 200.

The engagement assembly 702 may include a pin member 720, a follower spring 722 and the follower 724. The pin member 720 may include a cylindrical body portion 730 having an outer diameter that may be sized to slip-fit within the second portion 248 of the actuator aperture 244 that may be formed into the pin housing 214 of the transmission sleeve 200, as shown in FIG. 7. The pin member 720 may also include a tip portion 732 and a head portion 734. The tip portion 732 may be configured to engage the adjustment mechanism 704. The tip portion 732 may be formed into the end of the body portion 730 of the pin member 720 and may be defined by a spherical radius. The head portion 734 may be coupled (or may be integral) to the body portion 730 and spaced from the tip portion 732 and may be shaped in the form of a flat cylinder or barrel that may be sized to slip fit within the first portion 246 of the actuator aperture 244 (FIG. 7). Accordingly, the head portion 734 may prevent the pin member 720 from being urged forwardly out of the actuator aperture 274.

The follower spring 722 may be a compression spring whose outside diameter may be sized to slip fit within the first portion 246 of the actuator aperture 244 (FIG. 7). The forward end of the follower spring 722 may contact the head portion 734 of the pin member 720, while the opposite end of the follower spring 722 may contact the follower 724. The tip portion 740 of the follower 724 may have a rounded or spherical shape and may be configured to engage the clutch face 316.

The follower 724 may also include an end portion 744 having a cylindrically shaped body portion 746, a tip portion 748 and a flange portion 750. The body portion 746 may be sized to slip fit within the first portion 246 of the actuator aperture 244. The flange portion 750 may be formed where the body portion 746 extends outward away from the tip portion 740. The flange portion 750 may be generally flat and configured to receive a biasing force that may be exerted by the follower spring 722. In this regard, the end portion 744 of the follower may act as a spring follower to prevent the follower spring 722 from bending over when it may be compressed.

In further aspects of the present teachings and with reference to FIGS. 16, 16A, 16B and 16C, an alternative tip portion 752 may be configured to enclose a portion of a ball bearing 754. The tip portion 752 may include one or more tangs 756 that may hold the ball bearing 754 within an aperture 752 *a* formed within the tip portion 752. As illustrated, five tangs 756 may capture the ball bearing 754 within the tip portion 752. The tangs 756 of the tip portion 752 may be configured such that the ball bearing 754 may roll against the clutch face 316. The employment of the rolling ball bearing 754 may be shown to reduce friction at the interface the tip portion 752 and the clutch face 316 relative to a solid (unitary) tip portion 74 *a*. A flange portion 758 may be formed at the intersection between a body portion 760 and an end portion 762, and may be similar to that of the tip portion 740.

In another aspect of the present teachings and with reference to FIGS. 17, 17A, 17B and 17C, a tip portion 764 that may hold the ball bearing 754 may be configured in a two-piece configuration. The tip portion 764 may include two portions 766, 768 that may be fastened to one another using, for example, threads or another suitable fastening means. By constructing the tip portion 764 in two parts, the ball bearing 754 may be inserted between the two portions 766, 768, which may be fastened together and may urge the ball bearing 754 toward the tangs 756. It may be shown that manufacturing processes (e.g., heat treat or hardening) may be performed on portion 766 and/or portion 768 of the tip portion 764 and then later assembled to include the ball bearing 754.

Returning to FIG. 15, the adjustment mechanism 704 may also include an adjustment structure 770 and a setting collar 772. The adjustment structure 770 may be shaped in the form of a generally hollow cylinder that may be sized to fit over the spindle housing 21 of the output spindle assembly 20 (FIG. 3). The adjustment structure 770 may include an annular face 774 into which an adjustment profile 776 may be formed. Other features of the clutch mechanism 18 are disclosed in the references already incorporated by reference above.

With reference to FIGS. 3, 4 and 15, an initial drive torque may be transmitted by the motor pinion 46 from the motor assembly 14 to the first set of planet gears 312 causing the first set of planet gears 312 to rotate. In response to the rotation of the first set of planet gears 312, a first intermediate torque may be applied against the first ring gear 310. Resisting this torque may be a clutch torque that may be applied by the clutch mechanism 18. The clutch torque inhibits the free rotation of the first ring gear 310, causing the first intermediate torque to be applied to the first reduction carrier 314 and the remainder of the reduction gearset assembly 202 so as to multiply the first intermediate torque in a predetermined manner according to the setting of the speed selector mechanism 60. In this regard, the clutch mechanism 18 may bias the first reduction gear set 302 in the active mode.

The magnitude of the clutch torque may be dictated by the adjustment mechanism 704, and more specifically, the relative height of the adjustment profile 776 that may be in contact with the tip portion 732 of the pin member 720. Positioning of the adjustment mechanism 704 at a predetermined portion of the adjustment profile 776 may push the pin member 720 rearwardly in the actuator aperture 244, thereby compressing the follower spring 722 and producing the clutch force.

The clutch force may be transmitted to the flange portion 750 of the follower 724, causing the tip portion 740 of the follower 724 to engage the clutch face 316 and generate the clutch torque. Positioning of the tip portion 740 of the follower 724 in one of the valleys 778 in the clutch face 316 may operate to inhibit rotation of the first ring gear 310 relative to the transmission sleeve 200 when the magnitude of the clutch torque exceeds the first intermediate torque. When the first intermediate torque exceeds the clutch torque, however, the first ring gear 310 may be permitted to rotate relative to the transmission sleeve 200. Depending upon the configuration of the clutch face 316, rotation of the first ring gear 310 may cause the clutch force to increase a sufficient amount to resist further rotation. In such situations, the first ring gear 310 may rotate in an opposite direction when the magnitude of the first intermediate torque diminishes, permitting the tip portion 740 of the follower 724 to align in one of the valleys 778 in the clutch face 316. If rotation of the first ring gear 310 does not cause the clutch force to increase sufficiently so as to fully resist rotation of the first ring gear 310, the first reduction gearset 302 may rotate so as to limit the transmission of torque to the first reduction carrier 314, i.e., no torque multiplication.

Figure 18A:
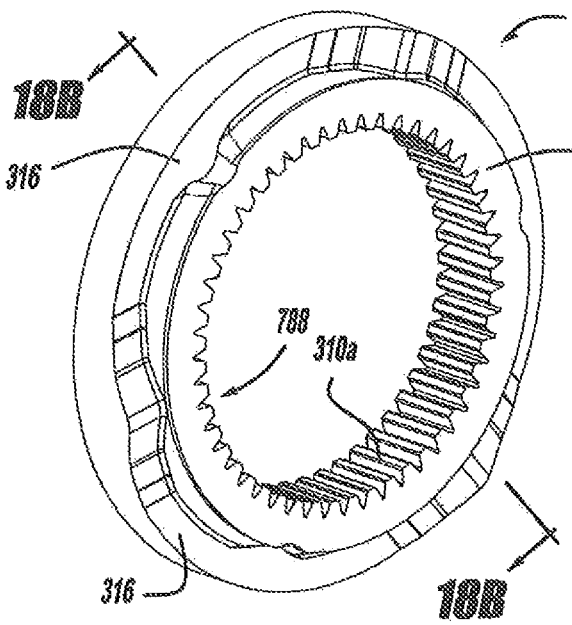
FIG. 18A is a perspective view of a ring gear having a clutch face formed thereon showing a wall forming an obtuse angle with the clutch face in accordance with the present teachings.
Figure 18B:
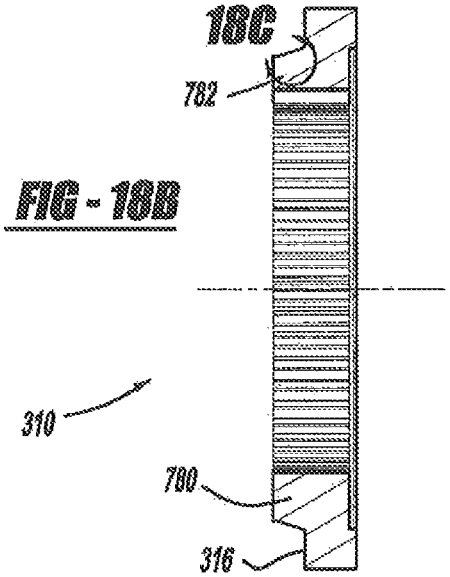
FIG. 18B is a cross-section view taken through FIG. 18.
Figure 18C:
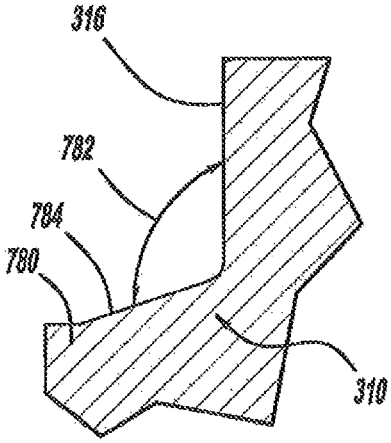
FIG. 18C is similar to FIG. 18B and shows the ring gear in further detail.
Figure 19:
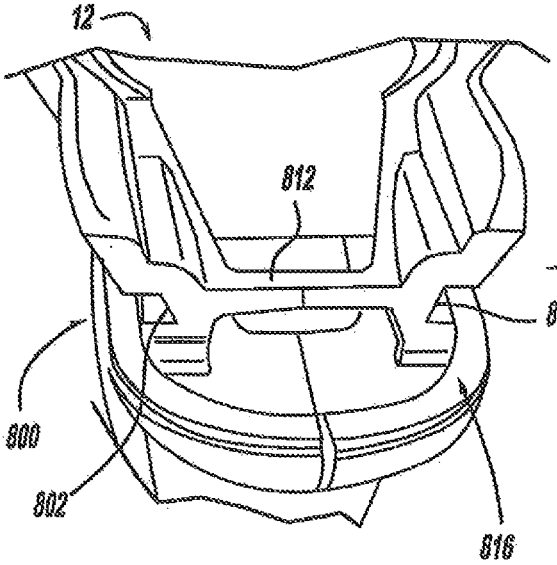
FIG. 19 is a perspective view of the housing of the power tool above a trigger assembly showing a connection face that receives a connection face on a spindle housing in accordance with the present teachings.
Figure 20:
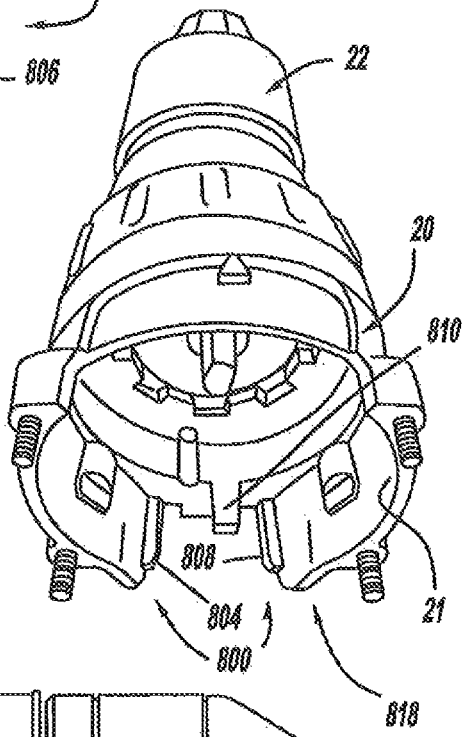
FIG. 20 is a perspective view of the spindle housing of the power tool showing the connection face that may be received by the connection face on the housing of FIG. 19 in accordance with the present teachings.
Figure 21:
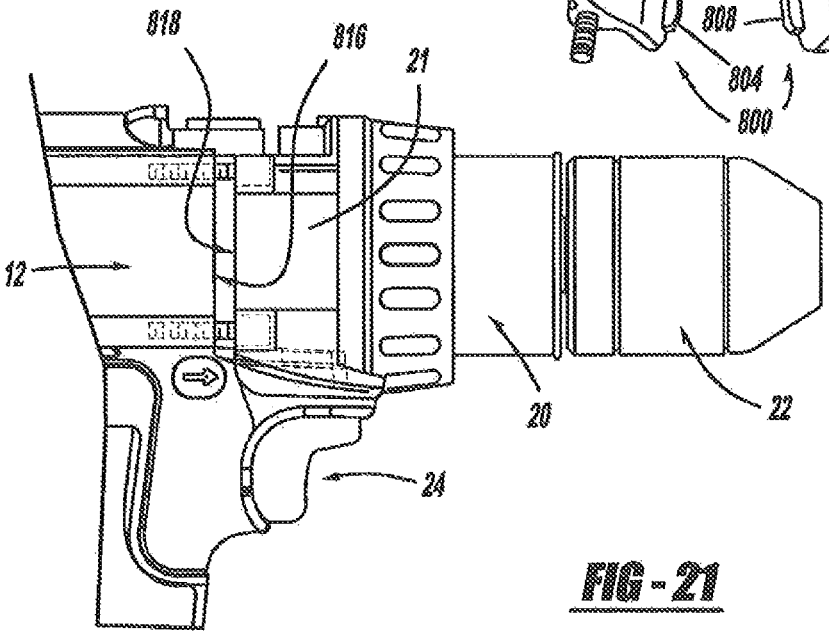
FIG. 21 is an exploded assembly view of the housing of FIG. 19 and the spindle housing of FIG. 20 showing a boss and a tongue on the spindle housing of FIG. 20 being received by a base and a groove, respectively, formed on the housing of FIG. 19 in accordance with the present teachings.

With reference to FIGS. 18A, 18B, and 18C, the first ring gear 310 may be configured with an annular wall 780 that may be adjacent the clutch face 316. The annular wall 780 may be at angle 782 that may be obtuse to the clutch face 316. A value of the angle 782 between the annular wall 780 and the clutch face 316 may be preferably about ninety five degrees to about one hundred fifty degrees but in the present example the value of the angle 782 may be more preferably about one hundred eleven degrees. Specifically, the wall 780 may include a first surface 784 and a second surface 786. The first surface 784 may extend from the clutch face at the obtuse angle 782. The second surface 786 may extend from the first surface 784 and may also extend from an inner surface 788 of the first ring gear 310 that may be associated with an inner diameter. The inner surface 788 may have gear teeth 310 *a*. The second surface 786 may be generally parallel to the clutch face 316 and may be generally perpendicular to the inner surface 788. By forming the first surface 784 of the wall 780 adjacent to the clutch face 316 at the obtuse angle 782 to the clutch face 316, it may be shown that the stress risers formed by the engagement assembly 702 (FIG. 15) contacting or striking the clutch face 316 may be reduced.

In one example, the value of the angle 782 formed between the first surface 784 of the wall 780 adjacent to the clutch face 316 face may also vary based on the circumferential position about the ring gear 316. In other examples, however, the value of the angle 782 formed between the first surface 784 of the wall 780 and the clutch face 316 may be fixed and thus not based on the circumferential position about the ring gear 316.

With reference to FIGS. 4, 19, 20 and 21, the housing 12 may be formed of two mating shells 34 that may be brought together to form the housing 12 of the tool 10. A portion of the housing 12 above the trigger assembly 24 may be configured with a tongue and groove 800 configuration. Specifically, a portion of the housing 12 above the trigger assembly 24 or trigger mount may include a first groove 802 that receives a first tongue 804 formed on the spindle housing 21. The portion of the housing 12 above the trigger assembly 24 may also include a second groove 806 that receives a second tongue 808 also formed on the spindle housing 21. The second groove 806 may be laterally spaced apart from the first groove 802.

In addition, the spindle housing 21 may include a boss or a rib 810 that extends from the spindle housing 20. The boss 810 may contact a base 812, when the spindle housing 21 connects to the housing 12. Moreover, one or more suitable fasteners 814 may connect the spindle housing 21 to the housing 12. In this regard, the pair of grooves 802, 806 and the base 812 may be part of a connection face 816 formed on the housing 12. The connection face 816 may mate with a connection face 818 which may be formed on the spindle housing 21 and may include the tongues 804, 808 and the boss 810.

When the connection faces 816, 818 are joined together, the tongues 804, 808 may be secured to the grooves 802, 806. Moreover, the boss or a rib 810 that may contact the base 812 may slightly deflect as the connection faces 816, 818 may be brought together. In this regard, the housing 12 may be secured (at least temporarily) to the output spindle housing 21 and then the suitable fasteners may be used to more securely attach the spindle housing 21 to the housing 12.

With reference to FIGS. 4, 22A and 22B, the tool 10 may include the spindle lock assembly 428. The spindle lock assembly 428 may include the anvil 426, a plurality of roller elements or pins 902 interspersed between five projections 904 that may extend from a face 906 of the third planet carrier 404. A spindle lock ring 908 may contain the five pins 902 and keep the pins 902 aligned with the projections 904. Other features and operation of the spindle lock assembly 428 are outside the scope of the present disclosure but provided in further detail in the references already incorporated by reference above. Briefly, the anvil 426 may be part of the drill or driver planetary gear transmission that transmits the power from the transmission to the output spindle assembly 20. The anvil 426 may allow movement between the third planet carrier 404 and the output spindle 430 in order to facilitate the spindle lock assembly 428. The spindle lock assembly 428 may provide an abutment to apply a force to the chuck 22 to, for example, tighten or loosen the chuck 22. When doing so, the spindle lock assembly 428 may prevent the tightening or loosening force from back-driving the transmission of the power tool 10.

The face 906 of the third planet carrier 404 may include, an aperture 910 in which a bottom portion 912 of the anvil 426 may be received. A gasket 914 between the anvil 426 and inner surface 916 of the aperture 910 formed in the third planet carrier 404 may be complementary in shape and/or size to the inner surface 916 and/or the shape of the bottom portion 912. As illustrated in FIG. 226, the bottom portion 912 of the anvil 426 may be shaped in five-prong configuration 918 and, as such, the gasket 914 may have a similar configuration so that the gasket 914 may be disposed between the anvil 426 and the aperture 910 in the face 906 of the third planet carrier 404.

In a further aspect of the present teachings and with reference to FIGS. 23A, 23B, 23C and 23D, an anvil 950 may be configured such that an aperture 952 that may be formed on the face 906 of the third planet carrier 404 may be a simple polygonal shape, such as a five-sided polygon. It will be appreciated that various suitable polygonal shapes may be used. In addition, a seal 954 may be disposed between the anvil 950 and the face 906. The seal 954 may further be disposed in a groove 956 formed on a face 957 of a top portion 918 of the anvil 950. The groove 956 may hold the seal 954. In this regard, the seal 954 may be a circular seal, e.g., an O-ring. By way of the above example, the seal 954 may be disposed between the face 906 and the groove 956 but may not be disposed between the bottom portion 912 and the inner surface 916 of the aperture 952. It may be shown that the circular seal 954 may be less costly than a shape-specific seal 914.

Figure 23A:
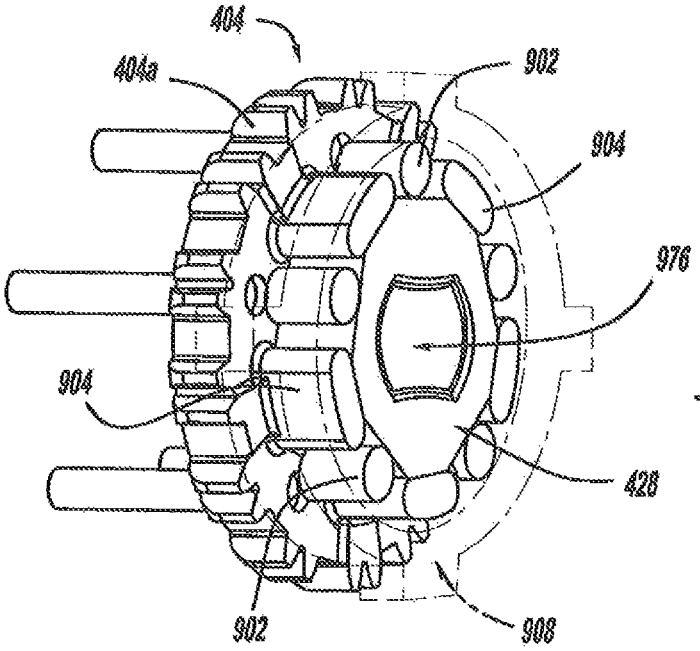
FIG. 23A is a perspective view of a planet carrier, anvil and portion of a spindle lock assembly in accordance with a further aspect of the present teachings.
Figure 23B:
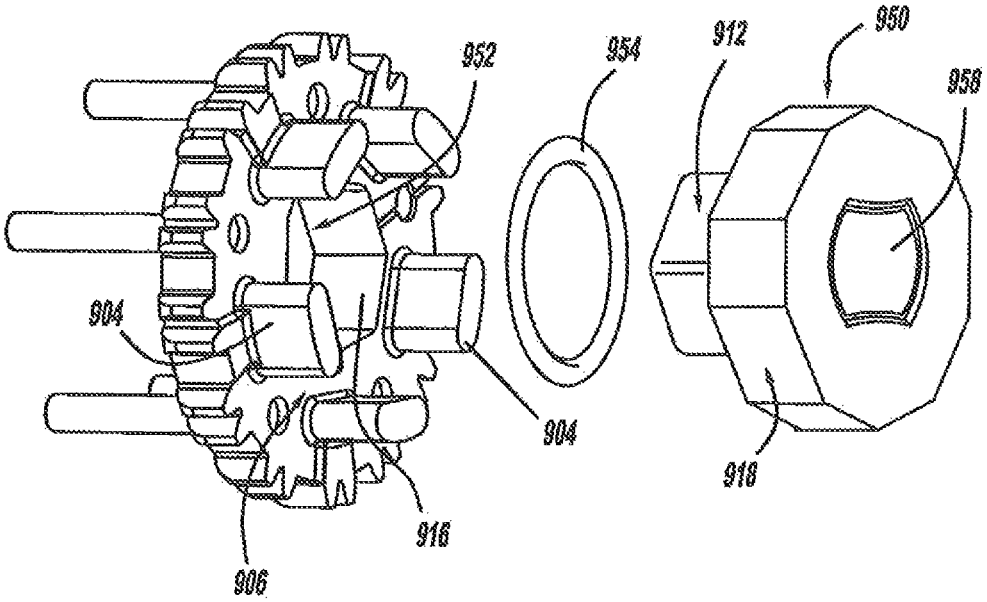
FIG. 23B is an exploded assembly view of the planet carder, the anvil and the portion of the spindle lock assembly of FIG. 23A and shows a circular gasket between the anvil and the planet carrier.
Figure 23C:
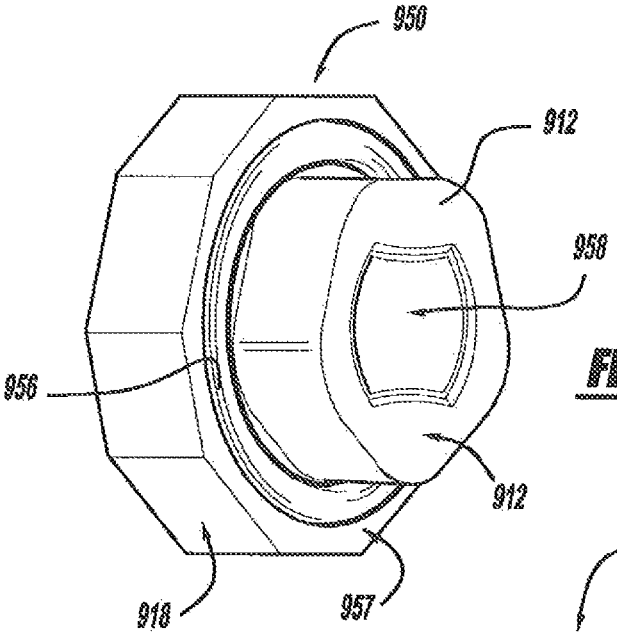
FIG. 23C is a perspective view of the anvil of FIGS. 23A and 23B showing the circular gasket.
Figure 23D:
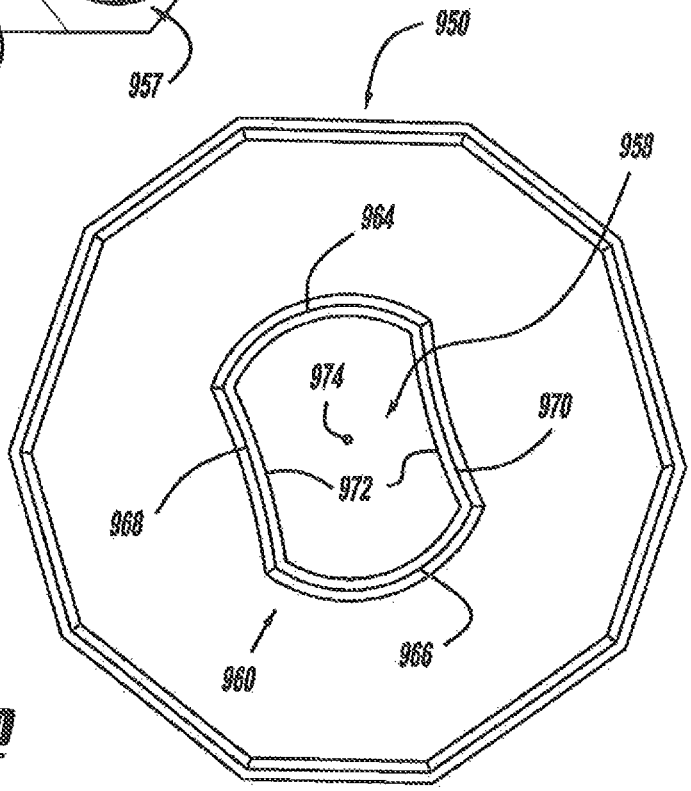
FIG. 23D is a front view of the anvil of FIG. 23C showing an aperture in which an output spindle may be received in accordance with the present teachings.

With reference to FIG. 23D, an aperture 958 formed in the anvil 950 may have four arcuate walls 950. In this regard, two of the walls may be opposed and D-shaped, such that a round portion 962 of each D-shape may form the first wall 964 and the second wall 966. The third wall 968 and the fourth wall 970 may be opposed to one another and may form a convex shape. The convex shape may have an apex 972 such that the apex of each wall 968, 970 may be closer to a center 974 of the aperture 958 than the inner surface 916 of the aperture 958. The shape of the aperture 958 relative to the shape of an aperture 976 on the anvil 426 (FIGS. 21A and 21B) may be shown to reduce stress between the output spindle 430 and the anvil 950 relative to the anvil 426. Moreover, the shape of the bottom portion 912 of the anvil 950 relative to the anvil 426 may permit the anvil 950 to be inserted into the aperture 952 at a plurality of orientations (i.e., five orientations for a five-sided bottom portion) relative to the anvil 426.

While specific examples have been described in the specification and illustrated in the drawings, it will be understood by those skilled in the art that various changes may be made and equivalents may be substituted for elements thereof without departing from the scope of the present teachings as defined in the claims. Furthermore, the mixing and matching of features, elements and/or functions between various examples may be expressly contemplated herein so that one skilled in the art would appreciate from the present teachings that features, elements and/or functions of one example may be incorporated into another example as appropriate, unless described otherwise above. Moreover, many modifications may be made to adapt a particular situation or material to the present teachings without departing from the essential scope thereof. Therefore, it may be intended that the present teachings not be limited to the particular examples illustrated by the drawings and described in the specification as the best mode presently contemplated for carrying out this invention, but that the scope of the present disclosure will include any aspects following within the foregoing description and the appended claims.

Example embodiments have been provided so that this disclosure will be thorough, and to fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Terms of degree such as "generally," "substantially," "approximately," and "about" may be used herein when describing the relative positions, sizes, dimensions, or values of various elements, components, regions, layers and/or sections. These terms mean that such relative positions, sizes, dimensions, or values are within the defined range or comparison (e.g., equal or close to equal) with sufficient precision as would be understood by one of ordinary skill in the art in the context of the various elements, components, regions, layers and/or sections being described.

Numerous modifications may be made to the exemplary implementations described above. These and other Implementations are within the scope of the following claims.

What is claimed is:

1. A power tool comprising:

a tool housing defining an interior cavity and a trigger mount, the trigger mount being adapted to receive a trigger therein;

a spindle housing containing an output spindle assembly having an output spindle rotatably mounted in the spindle housing; and a spindle lock assembly coupled to the output spindle and coupleable to an output member of a transmission in the tool housing when the spindle housing is coupled to the tool housing, wherein the spindle lock assembly comprises an anvil having a first portion that is coupled to the output spindle and a second portion received in an opening in the output member, wherein the first portion defines a groove that receives a seal between the first portion and the output member;

wherein one of the tool housing and the spindle housing includes a plurality of longitudinally-extending, spaced-apart tongues and the other of the tool housing and the spindle housing includes a plurality of longitudinally-extending, spaced-apart grooves, the spindle housing being couplable to the tool housing such that each of the grooves receive an associated one of the tongues to non-rotationally couple the spindle housing to the tool housing.

2. The power tool of claim 1, wherein the one of the tool housing and the spindle housing includes a rib disposed between the tongues and the other of the tool housing and the spindle housing includes a base portion disposed between the grooves, wherein the rib contacts the base portion when the spindle housing is coupled to the tool housing.

3. The power tool of claim 2, wherein the rib deflects a predetermined amount to exert a force on the base portion when the spindle housing is coupled to the tool housing, with a magnitude of the force based on a predetermined amount.

4. The power tool of claim 1, wherein the plurality of tongues comprises a pair of tongues on the spindle housing, and the plurality of grooves comprises a pair of grooves on the tool housing.

5. The power tool of claim 1, wherein the tool housing comprises two mating shells.

6. The power tool of claim 1, wherein the tool housing comprises a body portion that contains a motor and a transmission coupleable to the output spindle assembly, and a handle portion that is coupled to the body portion.

7. The power tool of claim 1, wherein the spindle lock assembly further comprises a lock ring surrounding at least a portion of the anvil, and a plurality of roller elements disposed between the lock ring and the anvil.

8. The power tool of claim 1, wherein the anvil comprises a polygonal portion and the opening in the output member comprises a polygonal opening in the output member, with the seal disposed between the polygonal portion and the polygonal opening.

9. The power tool of claim 1, wherein the groove and the seal are circular and the second portion and the opening are polygonal.

10. The power tool of claim 1, further comprising one or more fasteners configured to connect the spindle housing to the tool housing.

11. The power tool of claim 1, wherein the spindle lock assembly is configured to enable the output member of the transmission to drive the output spindle, while inhibiting the output spindle from back driving the output member.

12. A power tool comprising:

a tool housing having a body portion that contains a motor and a transmission, a handle portion coupled to the body portion, and a trigger mount that receives a trigger therein; and a spindle housing containing an output spindle assembly having a spindle lock assembly coupleable to an output member of the transmission and an output spindle coupled to the spindle lock assembly and rotatably mounted in the spindle housing, wherein spindle lock assembly comprises an anvil coupled to the output spindle and a seal disposed between the anvil and the output member, the spindle lock assembly configured to enable the output member to drive the output spindle, while inhibiting the output spindle from back driving the output member.

13. The power tool of claim 12, wherein the spindle lock assembly further comprises a lock ring surrounding at least a portion of the anvil and at least one roller element disposed between the lock ring and the anvil.

14. The power tool of claim 12, wherein one of the tool housing and the spindle housing includes a plurality of longitudinally-extending, spaced-apart tongues and the other of the tool housing and the spindle housing includes a plurality of longitudinally-extending, spaced-apart grooves, the spindle housing being coupleable to the tool housing such that the spindle lock assembly is coupled to the output member and each of the grooves receive an associated one of the tongues to non-rotationally couple the spindle housing to the tool housing.

15. The power tool of claim 14, wherein the one of the tool housing and the spindle housing includes a rib disposed between the tongues and the other of the tool housing and the spindle housing includes a base portion disposed between the grooves, wherein the rib contacts the base portion when the spindle housing is coupled to the tool housing.

16. The power tool of claim 15, wherein the rib deflects a predetermined amount to exert a force on the base portion when the spindle housing is coupled to the tool housing, with a magnitude of the force based on a predetermined amount.

17. The power tool of claim 12, wherein the anvil comprises a polygonal portion received in a polygonal opening in the output member, with the seal disposed between the polygonal portion and the polygonal opening.

18. The power tool of claim 12, wherein the anvil comprises a first portion that is coupled to the output spindle and a second portion received in an opening in the output member, wherein the first portion defines a groove that receives the seal between the first portion and the output member.

19. The power tool of claim 18, wherein the groove and the seal are circular and the second portion and the opening are polygonal.

* * * * *